US008682234B2

(12) United States Patent
Namba

(10) Patent No.: US 8,682,234 B2
(45) Date of Patent: Mar. 25, 2014

(54) TRANSFER DEVICE AND IMAGE FORMING APPARATUS

(75) Inventor: Haruyuki Namba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 174 days.

(21) Appl. No.: 13/338,894

(22) Filed: Dec. 28, 2011

(65) Prior Publication Data

US 2013/0058688 A1 Mar. 7, 2013

(30) Foreign Application Priority Data

Sep. 6, 2011 (JP) ..... 2011-194029

(51) Int. Cl.
*G03G 15/20* (2006.01)

(52) U.S. Cl.
USPC ..... 399/313

(58) Field of Classification Search
USPC ..... 399/313, 302
See application file for complete search history.

(56) References Cited

U.S. PATENT DOCUMENTS

| | | | | |
|---|---|---|---|---|
| 8,213,846 | B2 * | 7/2012 | Saito | 399/302 |
| 2008/0304878 | A1 * | 12/2008 | Matayoshi | 399/302 |
| 2010/0158586 | A1 * | 6/2010 | Yasumaru et al. | 399/313 |

FOREIGN PATENT DOCUMENTS

| | | |
|---|---|---|
| JP | A-2-212869 | 8/1990 |
| JP | A-10-73983 | 3/1998 |
| JP | A-11-143178 | 5/1999 |

* cited by examiner

*Primary Examiner* — Walter L Lindsay, Jr.
*Assistant Examiner* — Frederick Wenderoth
(74) *Attorney, Agent, or Firm* — Oliff PLC

(57) ABSTRACT

There is provided a transfer device that is used for transferring a developer image hold on a surface of an image supporting body to a first face of a transfer member transported and includes a transfer member that includes a conductive surface layer that is rotatable around a first rotation axis and be elastically transformed, forms a second contact area, which differs from the first contact area in a transporting direction of the transfer member, by contacting with a second face of the transfer member, and is supplied with a transfer voltage used for transferring the developer image onto the first face of the transfer member, a transformation unit that elastically transforms the transfer member, and an adjustment unit that adjusts a shape of the second contact area by adjusting the degree of elastic transformation of the transfer member.

16 Claims, 15 Drawing Sheets

TRANSFER DEVICE AND IMAGE FORMING APPARATUS

CROSS-REFERENCE TO RELATED APPLICATIONS

This application is based on and claims priority under 35 USC 119 from Japanese Patent Application No. 2011-194029 filed Sep. 6, 2011.

BACKGROUND

Technical Field

The present invention relates to a transfer device and an image forming apparatus.

SUMMARY

According to an aspect of the invention, there is provided a transfer device that is used for transferring a developer image hold on a surface of an image supporting body to a first face of a transfer member transported from an upstream side toward a downstream side, and the surface of the image supporting body and the transfer member are brought into contact with each other in a first contact area located on the first face, the transfer device including: a transfer member that includes a conductive surface layer that is rotatable around a first rotation axis and is elastically transformed, the transfer member having a second contact area that contacts with a second face of the transfer member, the second face being an opposite side of the transfer member to the first face, a transfer voltage which is used for transferring the developer image onto the first face of the transfer member being applied to the conductive surface layer, wherein the first contact area and the second contact area are located at different positions in a transporting direction of the transfer member; a transformation unit that transforms the transfer member elastically; and an adjustment unit that adjusts a shape of the second contact area by adjusting the degree of elastic transformation of the transfer member.

BRIEF DESCRIPTION OF THE DRAWINGS

Exemplary embodiments of the present invention will be described in detail based on the following figures, wherein.

DETAILED DESCRIPTION

Examples of a transfer device and an image forming apparatus according to a first exemplary embodiment of the present invention will be described.

Figure 1:
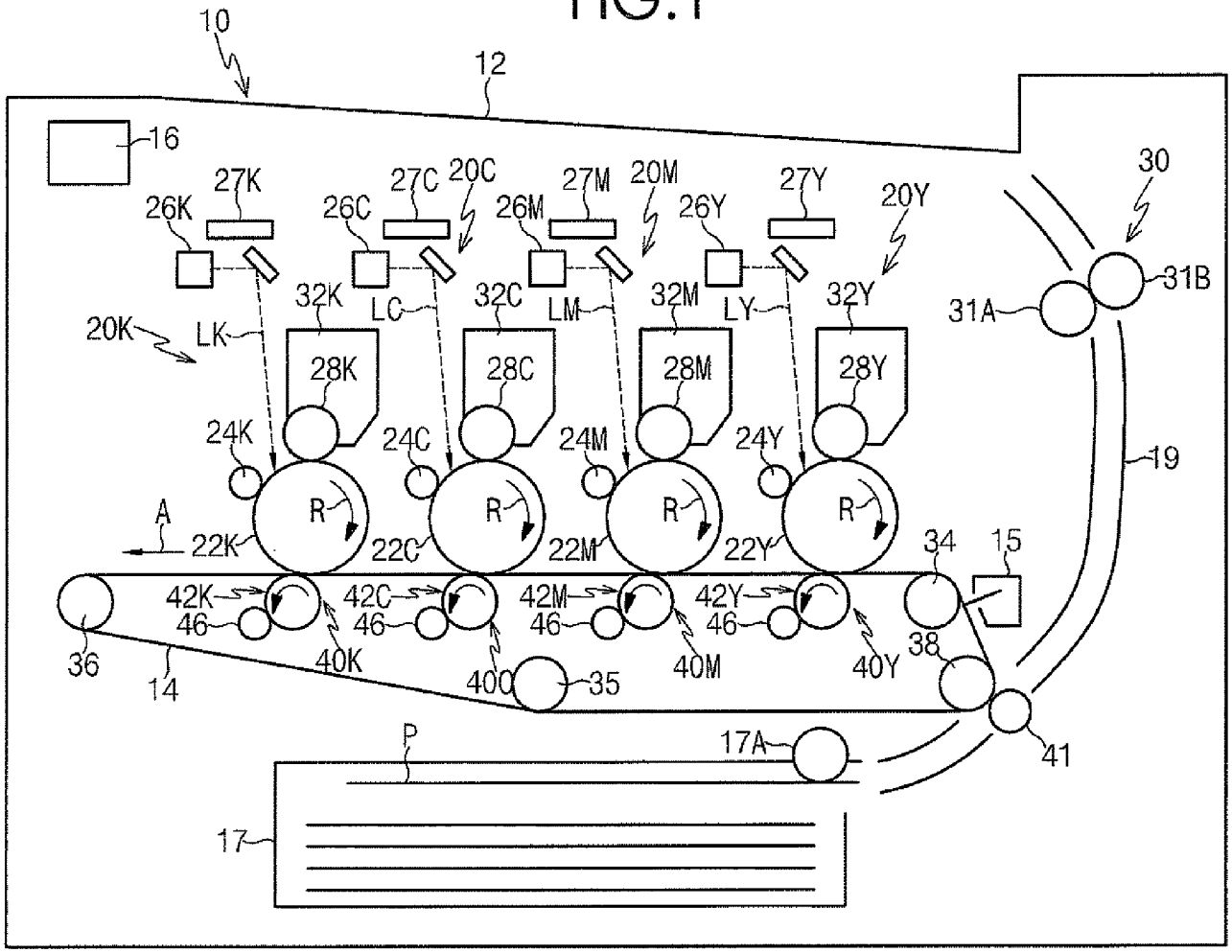
FIG. 1 is a configuration diagram illustrating the entire configuration of an image forming apparatus according to a first exemplary embodiment of the present invention.

FIG. 1 illustrates an image forming apparatus 10 as the first exemplary embodiment. The image forming apparatus 10 includes an enclosure housing 12 as an apparatus main body. Inside the enclosure housing 12, an intermediate transfer belt 14 as an example of a cylinder-shaped transfer member that revolves and moves in the direction of arrow A (the counter-clockwise direction illustrated in the figure), plural image forming sections 20Y, 20M, 20C, and 20K arranged along the rotation direction of the intermediate transfer belt 14, primary transfer units 40Y, 40M, 40C, and 40K as examples of a transfer device, which will be described later, disposed on the inner side of the intermediate transfer belt 14 in correspondence with the image forming sections 20Y, 20M, 20C, and 20K, and a main control section 16 that controls each section of the image forming apparatus 10 are included.

The image forming section 20Y is configured to include: a photoreceptor 22Y that has a cylinder shape, rotates in the direction (the clockwise direction illustrated in the figure) of arrow R, and supports a developer image (toner image) on the outer circumferential face thereof as an example of an image supporting member; a charging roll 24Y that charges the outer circumferential face of the photoreceptor 22Y; an exposure unit 26Y that forms an electrostatic latent image on the photoreceptor 22Y by exposing the charged outer circumferential face of the photoreceptor 22Y by using exposure light LY modulated based on image information of a Y color (yellow color); an image forming control section 27Y that controls the operation of the exposure unit 26Y; and a developer unit 32Y as an example of a developer image forming unit that includes a developing roll 28Y supporting Y color developer (toner) and forms a toner image (Y color) by developing the electrostatic latent image formed on the photoreceptor 22Y by using Y-color toner. In addition, at a position facing the outer circumferential face of the photoreceptor 22Y, a charge remover that removes electric charge remaining on the surface of the photoreceptor 22Y after the primary transfer of the toner image is disposed, which is not illustrated in the figure.

Here, the image forming sections 20M, 20C, and 20K are different from the image forming section 20Y only in the color of toner, and the other configurations thereof are the same as those of the image forming section 20Y. Thus subscripts M (magenta), C (cyan), and K (black) representing the toner colors are assigned to the ends of reference numerals of the members so as to be distinguishable from one another, and the description thereof will not be presented. In addition, in the description presented below, when the members do not need to be distinguished by the toner colors (Y, M, C, and K), a reference numeral not having each one of the subscript Y, M, C, or K may be used in description.

Print data including image data of an image to be formed on recording paper P is input to the main control section 16 through an input/output section (not illustrated in the figure). Then, after being decomposed into image information of each color (Y, M, C, and K) by the main control section 16, the print data is output to the image forming control sections 27Y, 27M, 27C, and 27K corresponding to each color. In addition, under the control of the image forming control section 27, the exposure unit 26 of each image forming section 20 is controlled so as to modulate the exposure light L. Furthermore, the units and sections disposed in the image forming apparatus 10 are electrically connected to the main control section 16.

The intermediate transfer belt 14, for example, is a cylinder-shaped member formed from a polyimide resin as its main ingredient and includes carbon black as a conducting agent, and the surface resistivity thereof is adjusted to 9 to 12 log Ω/□. On the inner side of the intermediate transfer belt 14, sequentially from the upstream side toward the downstream side in the direction of arrow A, a driving roll 34, primary transfer rolls 42Y, 42M, 42C, and 42K to be described later, a tensile strength applying roll 36 that applies tensile strength to the intermediate transfer belt 14, a support roll 35 that supports the intermediate transfer belt 14 from the inner side, and a backup roll 38 that is arranged at a secondary transfer position are disposed so as to be rotatable. The intermediate transfer belt 14 is supported by being wound around the driving roll 34, the primary transfer rolls 42Y, 42M, 42C, and 42K, the tensile strength applying roll 36, the support roll 35, and the backup roll 38 and is revolved and moved in the direction of arrow A by driving the driving roll 34 so as to rotate by using a driving unit (not illustrated in the figure).

In addition, on the outer side of the intermediate transfer belt 14, a belt cleaner 15 that is brought into contact with the intermediate transfer belt 14 so as to clean the surface thereof is disposed. Furthermore, on a side opposite to the backup roll 38 from the intermediate transfer belt 14, a secondary transfer roll 41 that transfers the toner image formed on the intermediate transfer belt 14 to the recording paper P is disposed. The secondary transfer roll 41 is connected to a voltage applying unit (not illustrated in the figure) and is applied with a voltage of the polarity that is opposite to that of the toner and transfers the toner image to the recording paper P in accordance with an electric potential difference between the backup roll 38 and the secondary transfer roll 41.

On the lower side of the intermediate transfer belt 14 in the lower portion of the inside of the enclosure housing 12, a box-shaped storage section 17 in which the recording paper P is stored is disposed. In the storage section 17, a feed roll 17A that feeds out the recording paper P one sheet at a time is disposed to be rotatable on the upper side near the secondary transfer roll 41. In addition, inside the enclosure housing 12, a sheet transport path 19 that is connected from the feed roll 17A to the upper face of the enclosure housing through the secondary transfer roll 41 is disposed. Furthermore, on the downstream side of the secondary transfer roll 41 in the transporting direction of the recording paper P in the sheet transport path 19, a fixing section 30 that fixes the toner image transferred to the recording sheet P is disposed.

The fixing section 30 includes a fixing roll 31A that is arranged on the toner-image face side of the recording paper P and includes an internal heat source and a pressing roll 31B that presses the recording paper P toward the fixing roll 31A. As the recording paper P enters a contact part (nip part) between the fixing roll 31A and the pressing roll 31B and is heated and pressed, the toner image is fixed to the recording paper P.

Next, the primary transfer unit 40 will be described.

Figure 2:
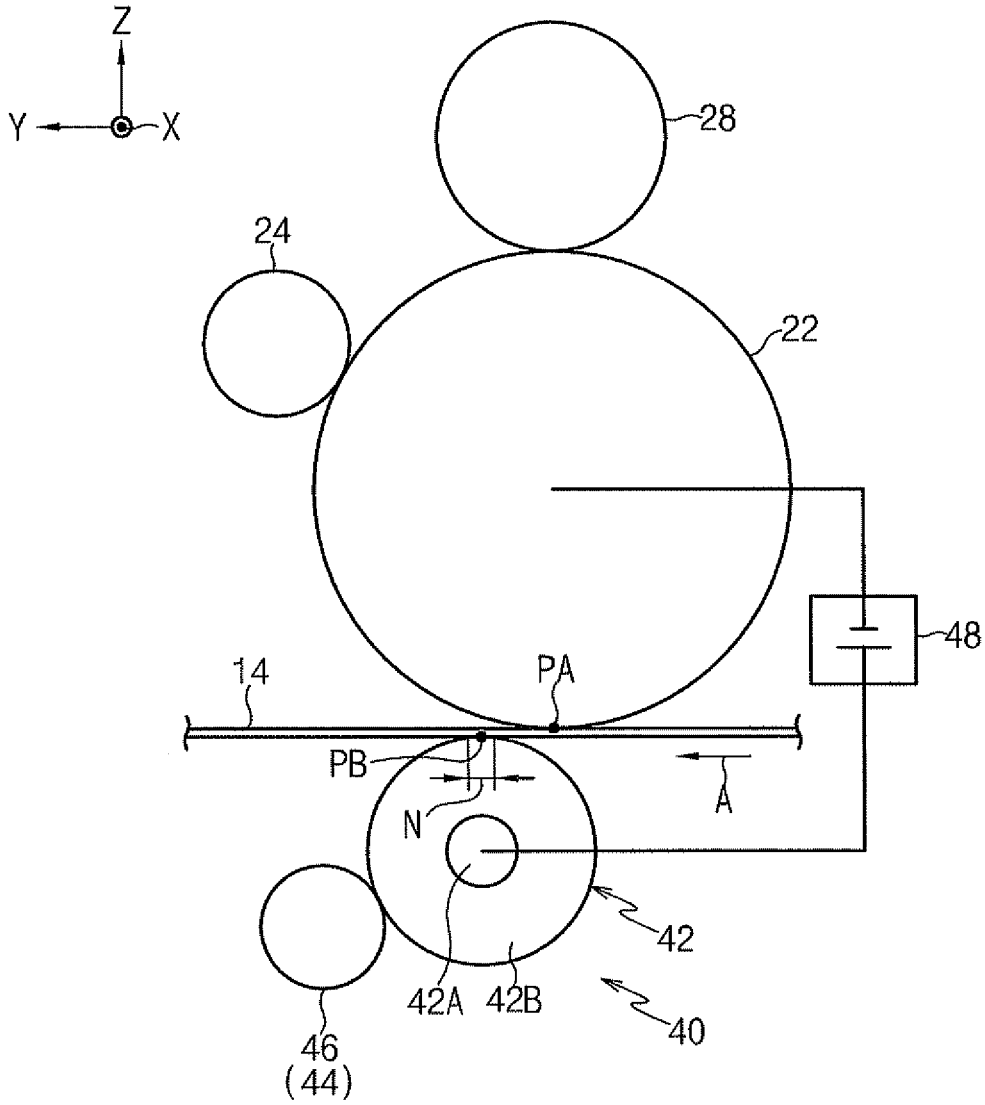
FIG. 2 is a configuration diagram of an image forming section and a primary transfer unit according to the first exemplary embodiment of the present invention.

As illustrated in FIG. 2, the primary transfer unit 40 is configured to include: a primary transfer roll 42 as an example of a transfer member that is supported to be rotatable by a bearing 54 (see FIG. 3A) to be described later and has an outer circumferential face being brought into contact with an inner circumferential face of the intermediate transfer belt 14; and a shape adjusting section 44 as an example of a shape adjusting unit that adjusts the shape of the primary transfer roll 42.

In the description presented below, the axial direction of the primary transfer roll 42 will be described as the X direction, a direction that is perpendicular to the X direction and is parallel to the moving direction (the direction of arrow A) of the intermediate transfer belt 14 will be described as the Y direction, and a direction that is perpendicular to the X direction and the Y direction will be described as the Z direction. In addition, a first contact part between the photoreceptor 22 and the intermediate transfer belt 14 in the Y-Z plane is denoted by PA, and a second contact part between the intermediate transfer belt 14 and the primary transfer belt 42 is denoted by PB. Furthermore, the contact width of the contact part PB between the intermediate transfer belt 14 and the primary transfer roll 42 in the Y direction is denoted by N. In this exemplary embodiment, to be described later, since the surface of the photoreceptor is a rigid body, the contact width of the first contact part PA is commonly narrower than that of the contact part PB between the primary transfer roll 42 having an elastic surface layer and the intermediate transfer belt 14. Accordingly, the contact width of the contact part PA is not illustrated in the figure. However, as long as the photoreceptor and the intermediate transfer belt are brought into contact with each other, it is apparent that there is a contact width to some extent.

The primary transfer roll 42, for example, is a roll member in which the outer circumferential face of a core 42A made of stainless steel (SUS) is coated with a urethane foam 42B containing an ion conducting agent. In addition, the primary transfer roll 42 is disposed to be rotatable on the downstream side of the first contact part PA in the transporting direction (the direction of arrow A) of the intermediate transfer belt 14 and is brought into contact with a face of the intermediate transfer belt 14 that is on the opposite side of the photoreceptor 22 so as to form the second contact part PB.

In addition, the core 42A of the primary transfer roll 42 is electrically connected to the photoreceptor 22 through a voltage applying section 48 as an example of a voltage applying unit. For example, the inner side of the photoreceptor 22 is grounded, and a voltage having a positive polarity that is opposite to the polarity (for example, the negative polarity) of the toner is applied to the core 42A by the voltage applying section 48. Accordingly, there is a difference of an electric potential between the electric potential of the photoreceptor 22 and the electric potential of the primary transfer roll 42. Then, in accordance with the action of an electric field formed based on the electric potential difference, the toner (toner image) hold in the photoreceptor 22 is transferred to the intermediate transfer belt 14.

Furthermore, the shape adjusting section 44 includes a shape adjusting roll 46 as an example of a shape adjusting member that is disposed to be rotatable with having the X direction as its axial direction and is brought into contact with the outer circumferential face of the primary transfer roll 42 and pressing parts 50A and 50B (see FIG. 3A) as examples of pressing units that independently press the one end and the other end of the shape adjusting roll 46 in the X direction toward the primary transfer roll 42.

The shape adjusting roll 46 is formed from a cylinder-shaped stainless steel (SUS) having the same cross-section in the X-Z plane in the X direction and has the length in the X direction to be in the level similar to the length of the core 42A of the primary transfer roll 42. In addition, one end (the front side in the figure) and the other end (the rear side in the figure) of the shape adjusting roll 46 in the X direction are supported to be rotatable by one set of bearings 56 (see FIG. 3A) to be described later.

Figure 4A:
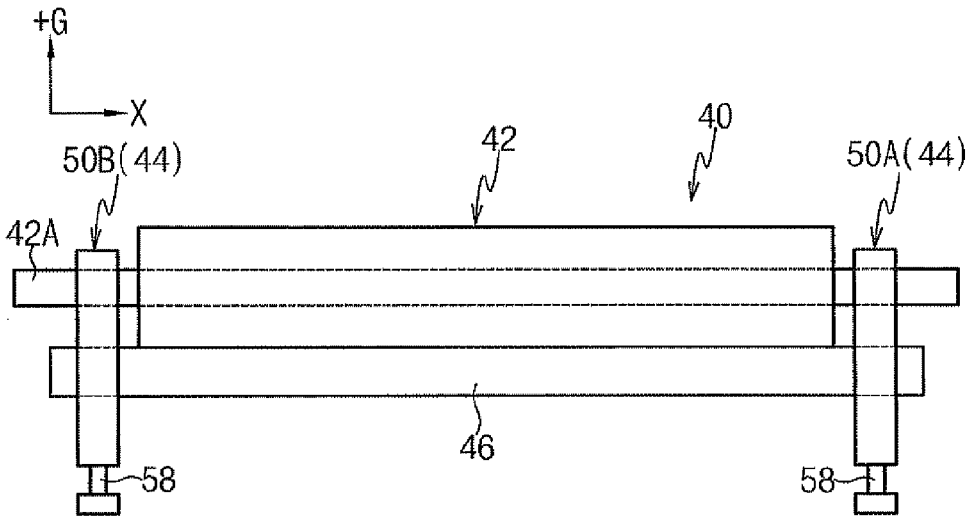
FIGS. 4A and 4B are a plan view and a cross-sectional view of the primary transfer unit according to the first exemplary embodiment of the present invention, viewed in a direction perpendicular to the pressing direction of the shape adjusting roll.
Figure 4B:
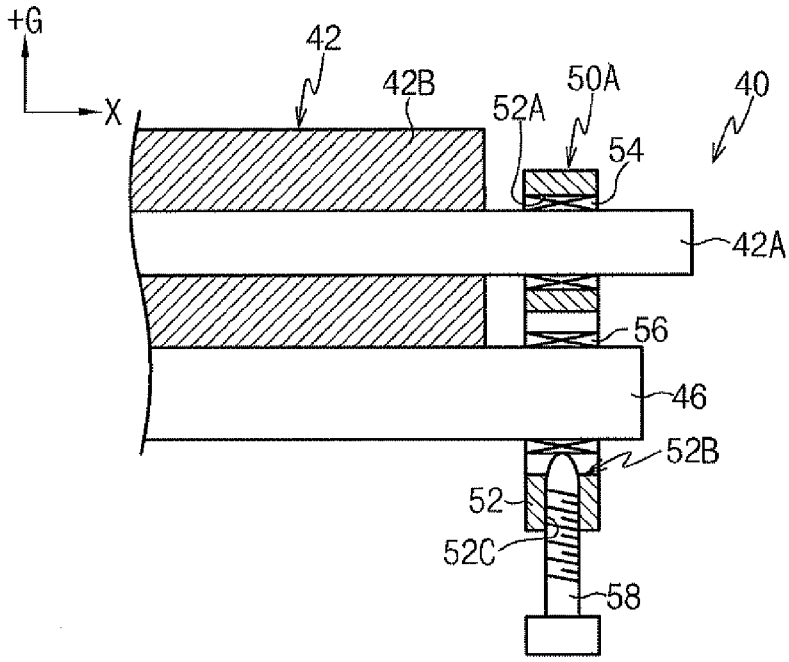

As illustrated in FIG. 4A, the pressing part 50A is disposed at one end of each of the primary transfer roll 42 and the shape adjusting roll 46, and the pressing part 50B is disposed at the other end of each of the primary transfer roll 42 and the shape adjusting roll 46. In addition, since the members that configure the pressing part 50A and the members that configure the pressing part 50B have similar configurations, in the description below, while the pressing part 50A will be described, the description of the pressing part 50B will not be presented.

Figure 3A:
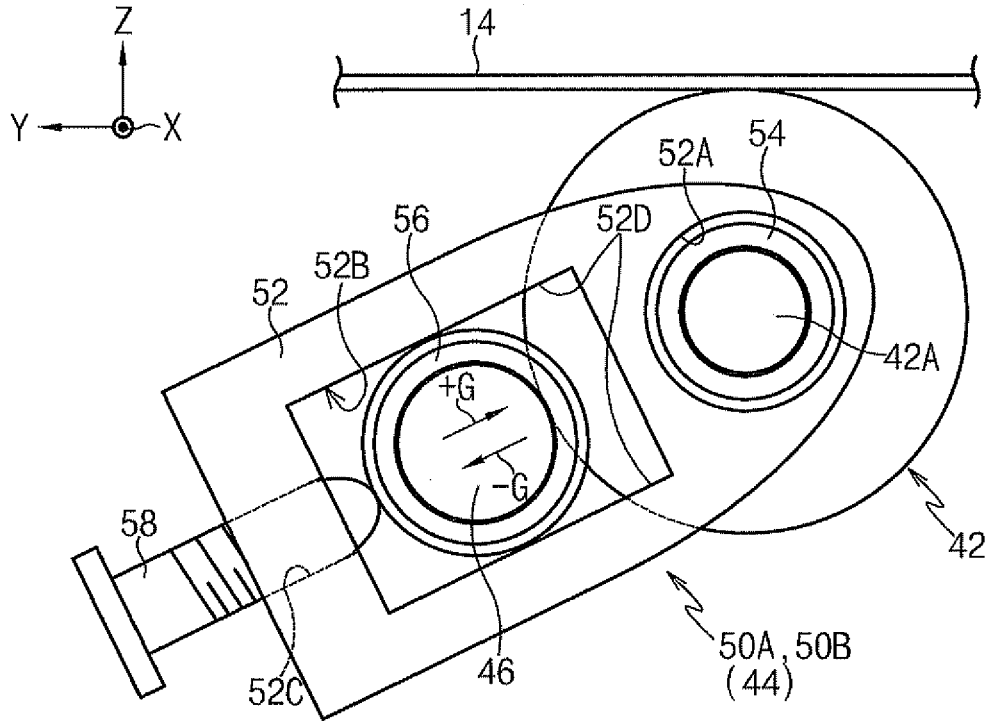
FIG. 3A is a configuration diagram of a pressing section according to the first exemplary embodiment of the present invention.

As illustrated in FIG. 3A, the pressing part 50A is configured to include: a holder 52 as an example of a support member that integrally supports one end of the primary transfer roll 42 and one end of the shape adjusting roll 46; a first bearing 54 into which one end of the primary transfer roll 42 is inserted; a second bearing 56 into which one end of the shape adjusting roll 46 is inserted; and a position adjusting screw 58 that urges the second bearing 56 toward the first bearing 54.

The holder 52 is a plate having the X direction as its thickness direction and has a circular through hole 52A that passes through it in the X direction at one end in the longitudinal direction, a rectangular opening portion 52B that passes through it in the X direction at the other end in the longitudinal direction, and a screw hole 52C that passes through it from the other end side in the longitudinal direction toward the inside of the opening portion 52B formed therein. The first bearing 54 is fitted into the through hole 52A so as to be fixed.

In the opening portion 52B, the outer circumferential face of the second bearing 56 is brought into contact with one set of inner walls 52D corresponding to the longer side of the rectangle. In addition, on the front side and the rear side of the inner wall 52D in the X direction, a plate-shaped stopper member (not illustrated in the figure) is disposed so as to bypass the shape adjusting roll 46, thereby preventing the second bearing 56 from being disengaged from the opening portion 52B.

In addition, the position adjusting screw 58 is screwed into the screw hole 52C of the holder 52, and the lead edge portion of the position adjusting screw 58 is brought into contact with the outer circumferential face of the second bearing 56. Accordingly, when the position adjusting screw 58 is turned in an advancing direction, the second bearing 56 is slid along the inner wall 52D in the direction (a direction in which the second bearing 56 approaches the first bearing 54) of arrow +G. On the other hand, when the position adjusting screw 58 is turned in a retreating direction, the second bearing 56 is slid along the inner wall 52D in the direction (a direction in which the second bearing 56 is separated away from the first bearing 54) of arrow −G. Here, since the pressing parts 50A and 50B are independent from each other, an inter-axial distance (corresponding to a segment OQ illustrated in FIG. 3B) between the primary transfer roll 42 and the shape adjusting roll 46 is configured to be independently adjusted.

Figure 3B:
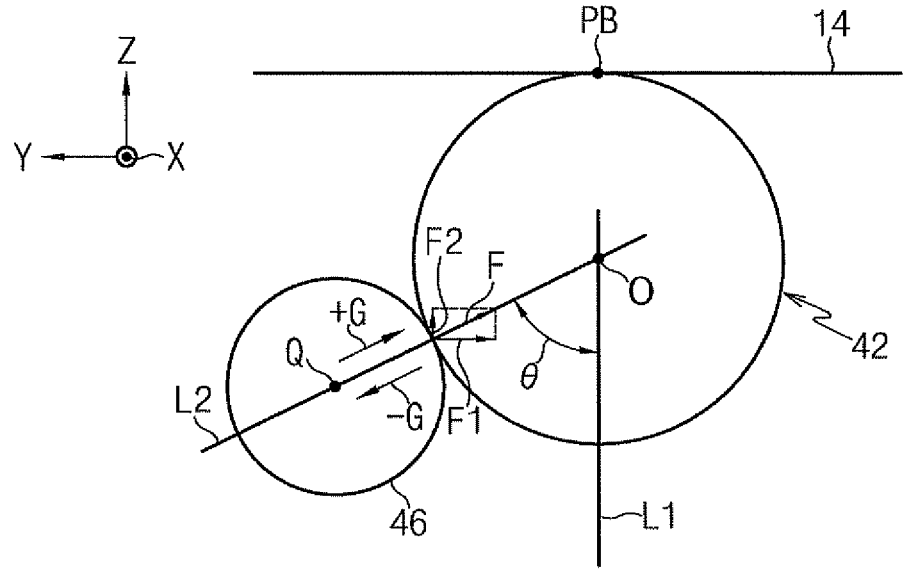
FIG. 3B is a schematic diagram illustrating a contact position between a primary transfer roll and a shape adjusting roll according to the first exemplary embodiment of the present invention.

In FIG. 3B, a schematic diagram is shown which illustrates a contact position of the shape adjusting roll 46 in the primary transfer roll 42. In FIG. 3B, the position of the rotation center of the primary transfer roll 42 is denoted by a point O, and the position of the rotation center of the shape adjusting roll 46 is denoted by a point Q. In addition, a straight line that passes though the point O and is parallel to the Z direction is denoted by L1, and a straight line that passes through the point O and the point Q is denoted by L2. The extending direction of the straight line L2 coincides with the direction of arrow +G and the direction of arrow −G.

An angle θ (the acute angle side) of the straight line L2 with respect to the straight line L1 is set as $0° \leq \theta \leq 90°$, and $\theta = 75°$ in this exemplary embodiment. In other words, the shape adjusting roll 46 is arranged on the side lower than the point O that is the position of the rotation center of the primary transfer roll 42 and at a position that allows the second contact part PB to approach the first contact part PA (see FIG. 2) when it is pressed by the pressing parts 50A and 50B (see FIG. 3A).

Next, an image forming process of the image forming apparatus 10 will be described.

In the image forming apparatus 10, when print data including image data of an image to be formed on recording paper P is input to the main control section 16, the print data is decomposed into image information of each color (Y, M, C, and K) by the main control section 16 and is output to the image forming control sections 27 corresponding to each color. Then, under the control of the image forming control sections 27, the exposure unit 26 of each image forming section 20 is controlled so as to modulate exposure light L corresponding to each color. Then, the modulated exposure light L is emitted to the surface of the photoreceptor 22 that is charged by the charging roll 24. By emitting the exposure light L to the surface of each photoreceptor 22 as above, an electrostatic latent image corresponding to the image information of a corresponding color is formed on each photoreceptor 22.

Subsequently, the electrostatic latent image formed on each photoreceptor 22 is developed using toner by each developer 32, whereby a toner image is formed on each photoreceptor 22. Then, the toner images formed on the photoreceptors 22 are sequentially primary transferred on the outer circumferential face of the intermediate transfer belt 14 by the primary transfer unit 40. In addition, attached materials such as residual toner attached to the surface of each photoreceptor 22 for which the primary transfer has been completed are removed by a cleaning unit (not illustrated in the figure), and the residual charge is removed, and residual electric charge is removed, for example, by the charge remover (not illustrated in the figure) that emits light to the photoreceptor 22.

The toner images overlapped with one another on the outer circumferential face of the intermediate transfer belt 14 through the primary transfer are transported to the secondary transfer roll 41 in accordance with the movement of the intermediate transfer belt 14. Then, the toner images are secondarily transferred to the recording paper P transported from the storage section 17 by the secondary transfer roll 41. In addition, the toner images that have been secondarily transferred to the recording paper P are fixed on the recording sheet 9 by the fixing section 30. The recording paper P on which the toner images are fixed as above is discharged to the upper face of the enclosure housing 12.

Next, the operation of the first exemplary embodiment will be described.

First, a distance between the first contact part PA and the second contact part PB when the shape adjusting roll 46 is pressed to the primary transfer roll 42 by the pressing parts 50A and 50B and a difference between the width of the center portion of the second contact part PB in the axial direction and the widths of both end portions thereof will be described.

Figure 5A:
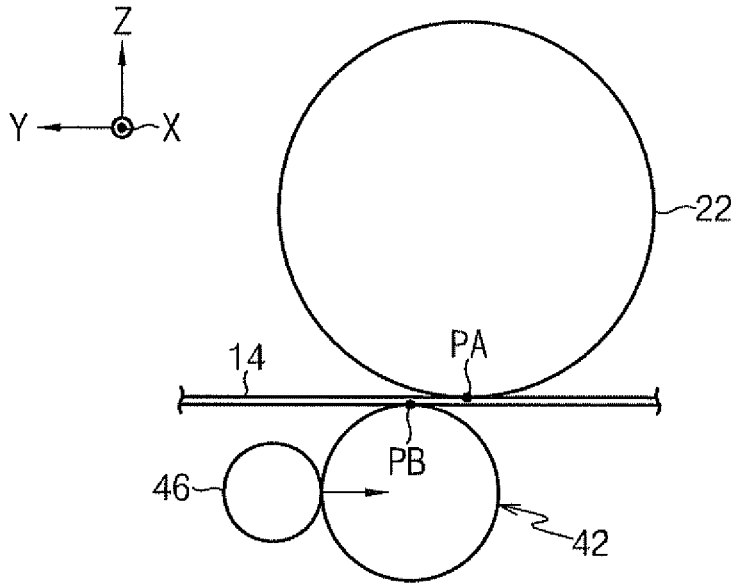
FIG. 5A is a schematic diagram illustrating a state in which the shape adjusting roll according to the first exemplary embodiment of the present invention is pressed in a direction opposite to the Y direction.

When the angle θ that represents the arrangement of the shape adjusting roll 46 is 90°, as illustrated in FIG. 5A, the shape adjusting roll 46 presses the primary transfer roll 42 in a direction (the direction approaching the photoreceptor 22 side) opposite to the Y direction. Here, the core 42A (see FIG. 3A) of the primary transfer roll 42 is supported on both end portions in the axial direction (the X direction) but is not supported at the center portion. Accordingly, when an external force is applied to the outer circumferential face of the primary transfer roll 42, the center portion is deformed in the applying direction of the external force more than the both end portions.

Figure 5B:
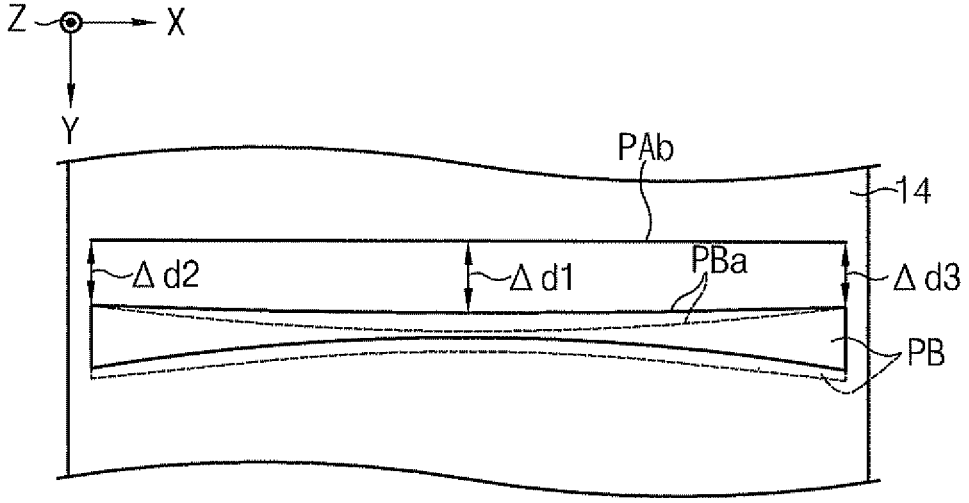
FIG. 5B is a schematic diagram illustrating a distance between a first contact part and a second contact part when the shape adjusting roll according to the first exemplary embodiment of the present invention is pressed in the direction opposite to the Y direction.

Accordingly, as illustrated in FIG. 5B, the center portion of the second contact part is moved in a direction (the first contact part PA side) opposite to the Y direction. Thus, a difference between a separation distance Δd1 between the downstream-side end portion PAb (denoted by a straight line) of the first contact part PA and the upstream-side end portion PBa (denoted by a curve) of the second contact part PB in the center portion of the primary transfer roll 42 (see FIG. 5A) in the axial direction and separation distances Δd2 and Δd3 between the downstream-side end portion PAb of the first contact part PA and the upstream-side end portion PBa of the second contact part PB in both end portions in the axial direction decreases.

In this manner, when the angle θ is 90°, the shape adjusting roll 46 moves the center portion of the upstream-side end portion PBa of the second contact part PB in the axial direction to be close to the downstream-side end portion PAb of the first contact part PA, so that a separation distance between the downstream-side end portion PAb of the first contact part PA and the upstream-side end portion PBa of the second contact part PB is at the same level in the axial direction. Here, the reason for forming the contact area of the second contact part PB in the intermediate transfer belt 14 in a hand drum shape as illustrated in FIG. 5B is that the center portion of the primary transfer roll 42 is not supported as described above, and the contact pressure between the intermediate transfer belt 14 and the primary transfer roll 42 in the center portion in the axial direction is lower than the contact pressure between the intermediate transfer belt 14 and the primary transfer roll 42 in each end portion in the axial direction.

Figure 6A:
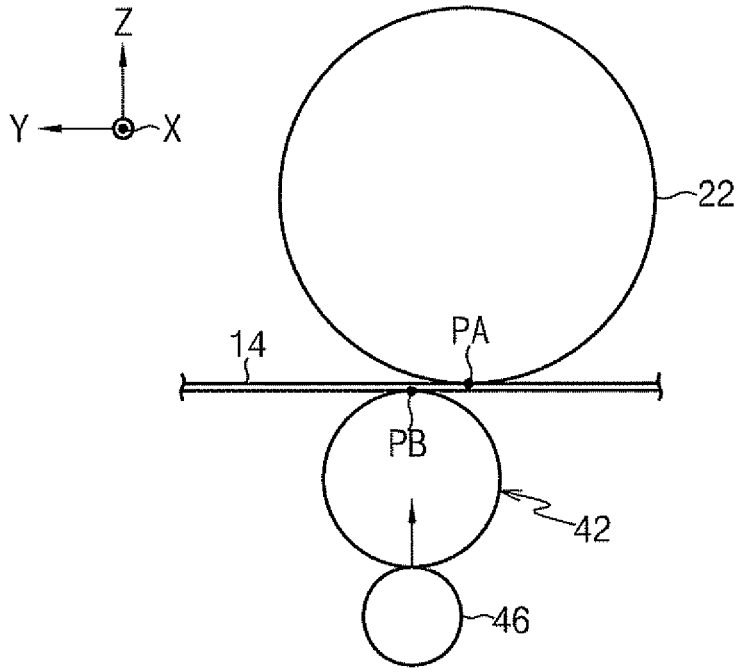
FIG. 6A is a schematic diagram illustrating a state in which the shape adjusting roll according to the first exemplary embodiment of the present invention is pressed in the Z direction.

On the other hand, when the angle θ illustrating the arrangement of the shape adjusting roll 46 is 0°, as illustrated in FIG. 6A, the shape adjusting roll 46 presses the primary transfer roll 42 in the Z direction (the direction approaching the intermediate transfer belt 14).

Figure 6B:
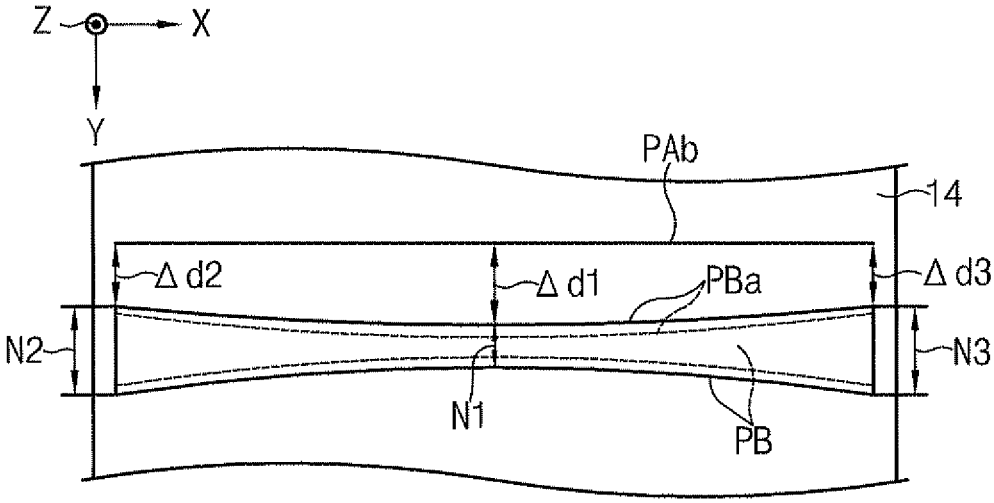
FIG. 6B is a schematic diagram illustrating a distance between the first contact part and the second contact part when the shape adjusting roll according to the first exemplary embodiment of the present invention is pressed in the Z direction.

Accordingly, as illustrated in FIG. 6B, as the width N of the second contact part PB in the Y direction, all the width N1 of the center portion in the axial direction and the widths N2 and N3 of both end portions increase. In addition, the external force applied to the primary transfer roll 42 by the shape adjusting roll 46 is only in the Z direction, but there is no component in a direction opposite to the Y direction, whereby there is no change in the above-described difference between the separation distance Δd1 and the separation distances Δd2 and Δd3. As above, when the angle θ is 0°, the shape adjusting roll 46 increases the width of the second contact part PB in the Y direction in the center portion and both end portions in the axial direction.

On the other hand, as illustrated in FIG. 3B, when the angle θ=75°, an external force F in the direction of arrow +G direction acts on the primary transfer roll 42 from the shape adjusting roll 46, and the external force F is decomposed into a component force F1 in a direction opposite to the Y direction and a component force F2 in the Z direction. In other words, when the angle θ is more than 0° and less than 90°, the component force F1 in the direction opposite to the Y direction and the component force F2 in the Z direction act on the primary transfer roll 42. Accordingly, the above-described difference between the separation distance Δd1 and the separation distances Δd2 and Δd3 is decreased, and the width of the second contact part PB in the Y direction increases in the center portion and both end portions in the axial direction.

Figure 7A:
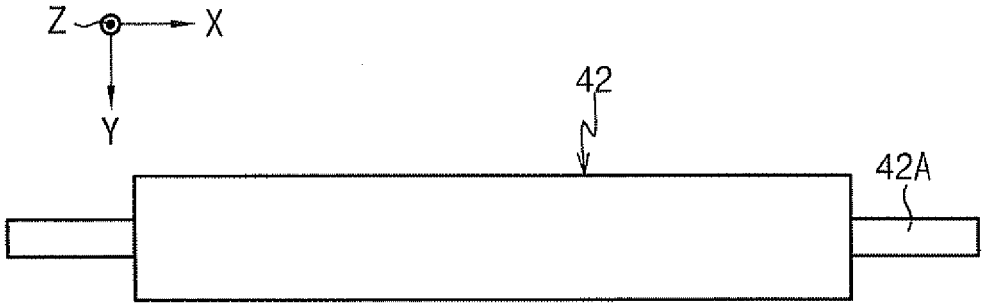
FIG. 7A is a schematic diagram illustrating a cylinder-shaped primary transfer roll according to the first exemplary embodiment of the present invention.
Figure 7B:
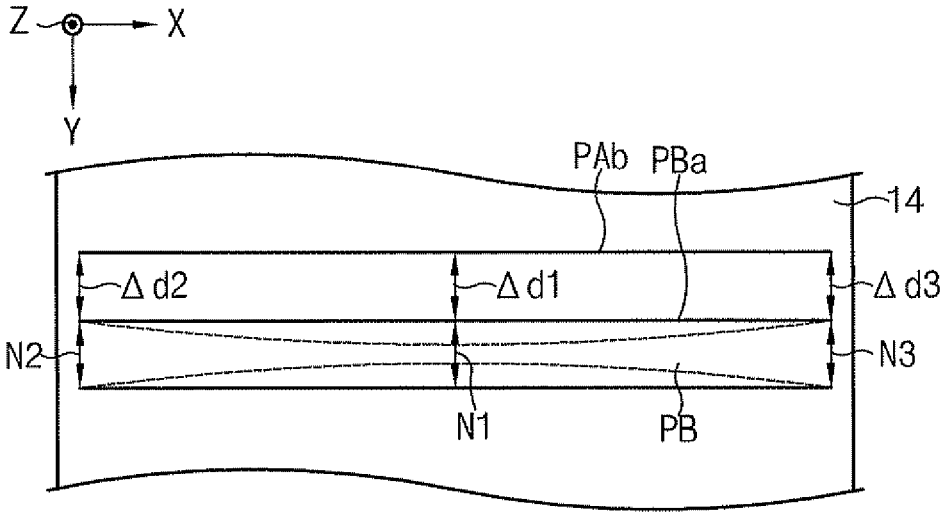
FIG. 7B is a schematic diagram illustrating a distance between the first contact part and the second contact part when the shape adjusting roll according to the first exemplary embodiment of the present invention is pressed.

As illustrated in FIG. 7A, in the case of the primary transfer roll 42 having the same external form in the X direction, as illustrated in FIG. 7B, the separation distance Δd1 between the downstream-side end portion PAb of the first contact part PA and the upstream-side end portion PBa of the second contact part PB in the center portion of the primary transfer roll 42 (see FIG. 7A) in the axial direction and separation distances Δd2 and Δd3 between the downstream-side end portion PAb of the first contact part PA and the upstream-side end portion PBa of the second contact part PB in both end portions in the axial direction are at the same level. In addition, as illustrated in FIG. 4A, the amount of intrusion of the shape adjusting roll 46 into the primary transfer roll 42 according to the pressing part 50A and the amount of intrusion of the shape adjusting roll 46 into the primary transfer roll 42 according to the pressing part 50B are assumed to be the same.

In addition, as the width N of the second contact part PB in the Y direction, the width N1 of the center portion and the widths N2 and N3 of both end portions in the axial direction are at the same level. Here, broken lines represent the shape of the second contact part PB in a case where the shape adjusting roll 46 (see FIG. 3A) is not used. As above, by using the shape adjusting roll 46, compared to a case where the shape adjusting roll 46 is not used, the difference between the separation distance Δd1 and the separation distances Δd2 and Δd3 is decreased, and the difference between the width N1 of the center portion and the widths N2 and N3 of both end portions of the second contact part PB is decreased.

Figure 8A:
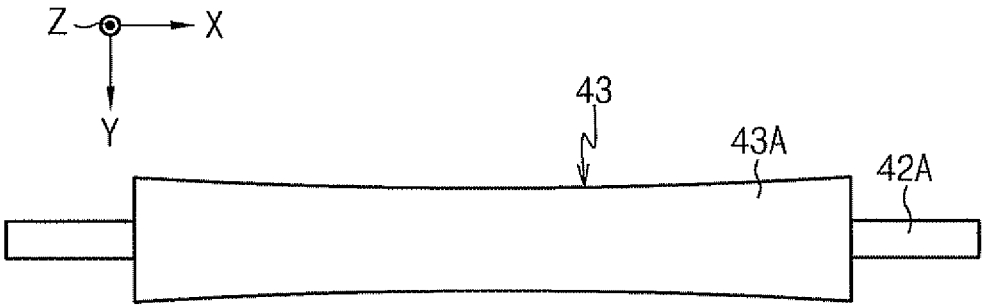
FIG. 8A is a schematic diagram illustrating a hand drum-shaped primary transfer roll according to the first exemplary embodiment of the present invention.
Figure 8B:
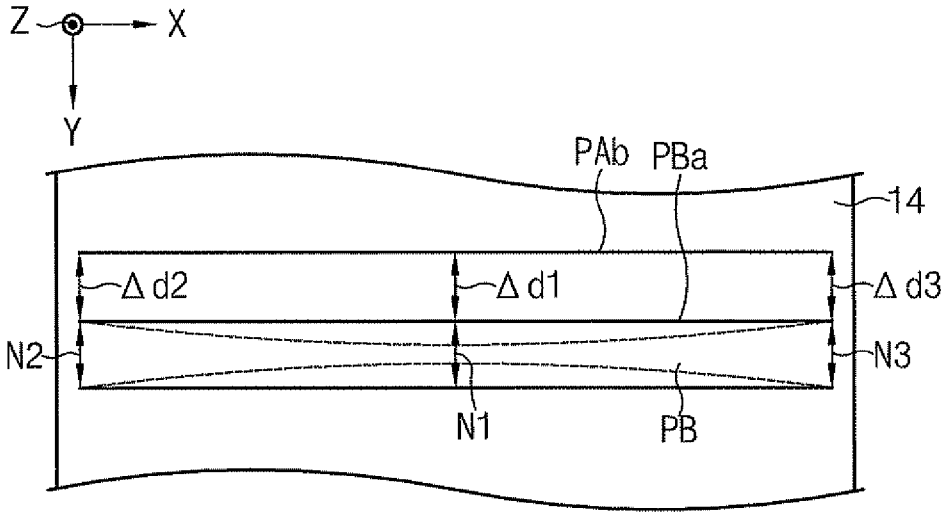
FIG. 8B is a schematic diagram illustrating a distance between the first contact part and the second contact part when the shape adjusting roll according to the first exemplary embodiment of the present invention is pressed.

As illustrated in FIG. 8A, in the case of the primary transfer roll 43 having an external form of a hand drum shape in which the center portion is thinner than both end portions, as illustrated in FIG. 8B, the separation distance Δd1 at the center portion of the primary transfer roll 43 (see FIG. 8A) in the axial direction is slightly shorter than the separation distances Δd2 and Δd3 at both end portions in the axial direction. In addition, as the width N of the second contact part PB in the Y direction, the width N1 of the center portion in the axial direction is slightly shorter than the widths N2 and N3 of both end portions.

As above, even in a case where the primary transfer roll 43 has a hand drum shape, by using the shape adjusting roll 46, compared to the configuration in which the shape adjusting roll 46 is not used, the difference between the separation distances Δd1 and the separation distances Δd2 and Δd3 is decreased, and the difference between the width N1 of the center portion and the widths N2 and N3 of both end portions of the second contact part PB is decreased. In FIG. 8B, broken lines represent the shape of the second contact part PB in a case where the shape adjusting roll 46 (see FIG. 3A) is not used. In addition, as illustrated in FIG. 8A, the primary transfer roll 43 is a roll member in which the outer circumferential face of the core 42A is coated with a urethane foam 43A containing an ion conducting agent. Furthermore, the amount of intrusion of the shape adjusting roll 46 into the primary transfer roll 43 according to the pressing part 50A (see FIG. 4A) and the amount of protrusion of the shape adjusting roll 46 into the primary transfer roll 43 according to the pressing part 50B (see FIG. 4A) are assumed to be the same.

Figure 9A:
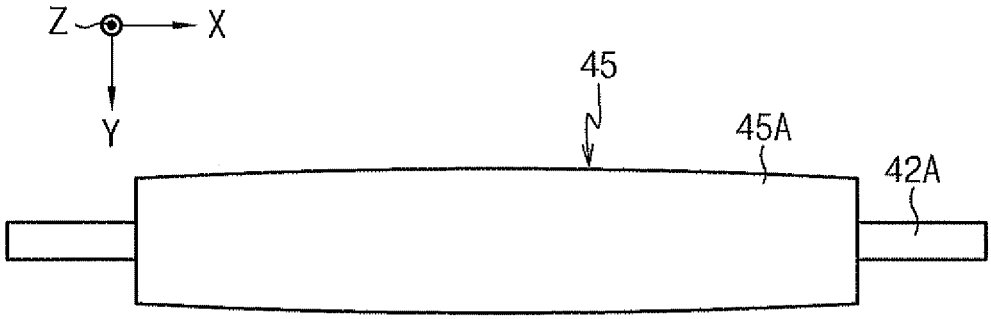
FIG. 9A is a schematic diagram illustrating a reverse hand drum-shaped primary transfer roll according to the first exemplary embodiment of the present invention.
Figure 9B:
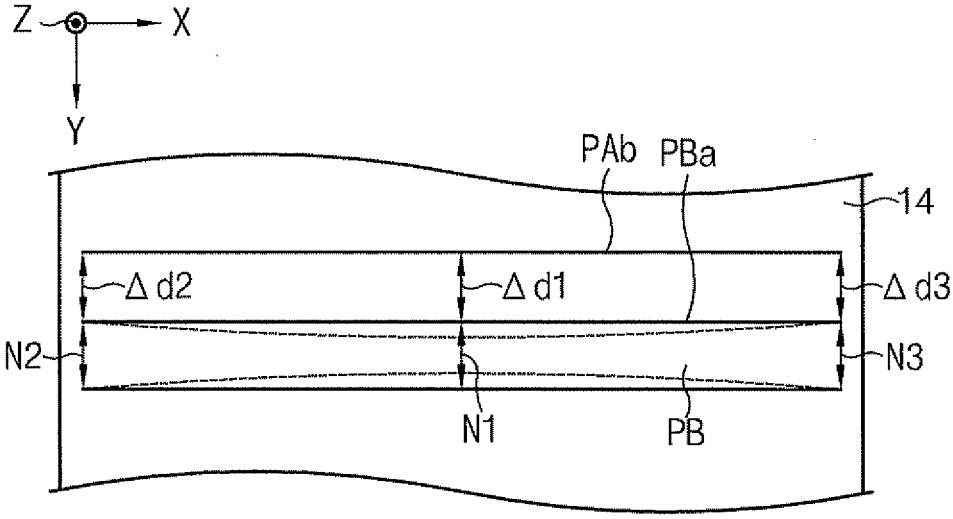
FIG. 9B is a schematic diagram illustrating a distance between the first contact part and the second contact part when the shape adjusting roll according to the first exemplary embodiment of the present invention is pressed.

As illustrated in FIG. 9A, in the case of the primary transfer roll 45 having an external form of a reverse hand drum shape in which the center portion is thicker than both end portions, as illustrated in FIG. 9B, the separation distance Δd1 at the center portion of the primary transfer roll 45 (see FIG. 8A) in the axial direction is slightly longer than the separation distances Δd2 and Δd3 at both end portions in the axis direction. In addition, as the width N of the second contact part PB in the Y direction, the width N1 of the center portion in the axial direction is slightly longer than the widths N2 and N3 of both end portions.

As above, even in a case where the primary transfer roll 45 has a reverse hand drum shape, by using the shape adjusting roll 46, compared to the configuration in which the shape adjusting roll 46 is not used, the difference between the separation distances Δd1 and the separation distances Δd2 and Δd3 is decreased, and the difference between the width N1 of the center portion and the widths N2 and N3 of both end portions of the second contact part PB is decreased. In FIG. 9B, broken lines represent the shape of the second contact part PB in a case where the shape adjusting roll 46 (see FIG. 3A) is not used. In addition, as illustrated in FIG. 9A, the primary transfer roll 45 is a roll member in which the outer circumferential face of the core 42A is coated with a urethane foam 45A containing an ion conducting agent. Furthermore, the amount of intrusion of the shape adjusting roll 46 into the primary transfer roll 45 according to the pressing part 50A (see FIG. 4A) and the amount of intrusion of the shape adjusting roll 46 into the primary transfer roll 45 according to the pressing part 50B (see FIG. 4A) are assumed to be the same.

Figure 10A:
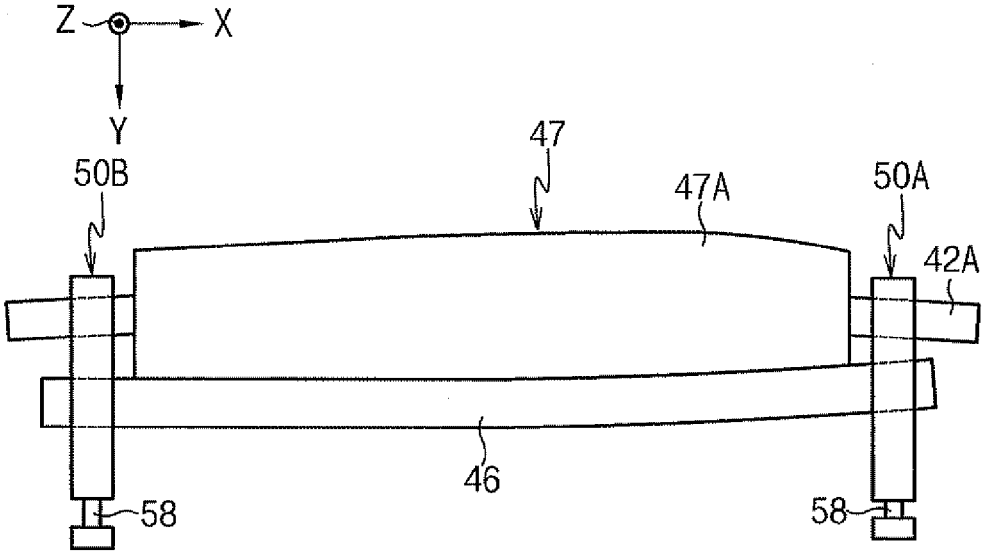
FIG. 10A is a schematic diagram illustrating an asymmetric-shaped primary transfer roll according to the first exemplary embodiment of the present invention.
Figure 10B:
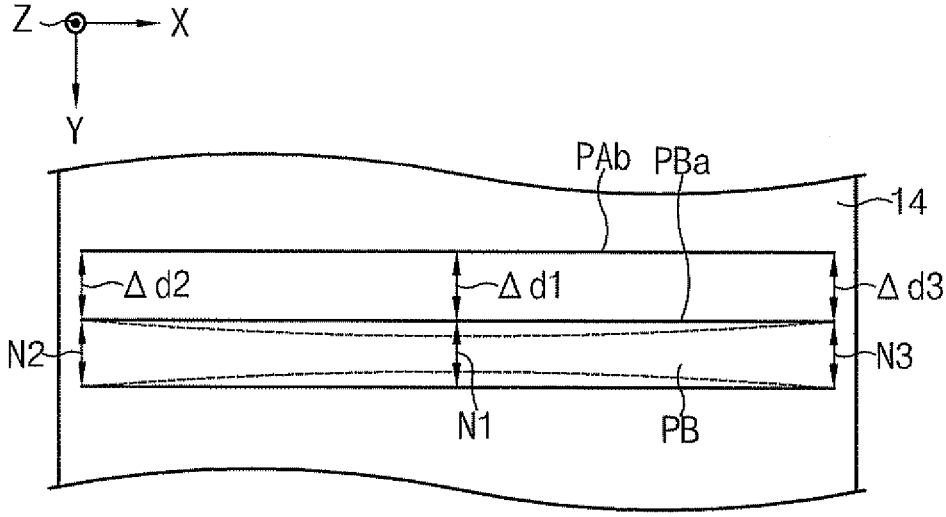
FIG. 10B is a schematic diagram illustrating a distance between the first contact part and the second contact part when the shape adjusting roll according to the first exemplary embodiment of the present invention is pressed.

On the other hand, as illustrated in FIG. 10A, in the case of a primary transfer roll 47 having different external forms on the pressing part 50A side and the pressing part 50B side in the axial direction (the X direction), the pressing part 50A or the pressing part 50B is independently adjusted, and the amount of intrusion of any one of the shape adjusting roll 46 into the primary transfer roll 47 is increased or decreased. Accordingly, as illustrated in FIG. 10B, a difference between the separation distance Δd1 at the center portion of the primary transfer roll 47 (see FIG. 10A) in the axial direction and the separation distances Δd2 and Δd3 at both end portions in the axial direction is decreased. In addition, regarding the width N of the second contact part PB in the Y direction, a difference between the width N1 of the center portion in the axial direction and the widths N2 and N3 of both end portions is decreased. Furthermore, as illustrated in FIG. 10A, the primary transfer roll 47 is a roll member in which the outer circumferential face of the core 42A is coated with a urethane foam 47A containing an ion conducting agent.

Next, a difference in the transfer current flowing from the primary transfer roll 42 to the photoreceptor 22 through the intermediate transfer belt 14 depending on the presence of the shape adjusting roll 46 will be described.

Figure 11A:
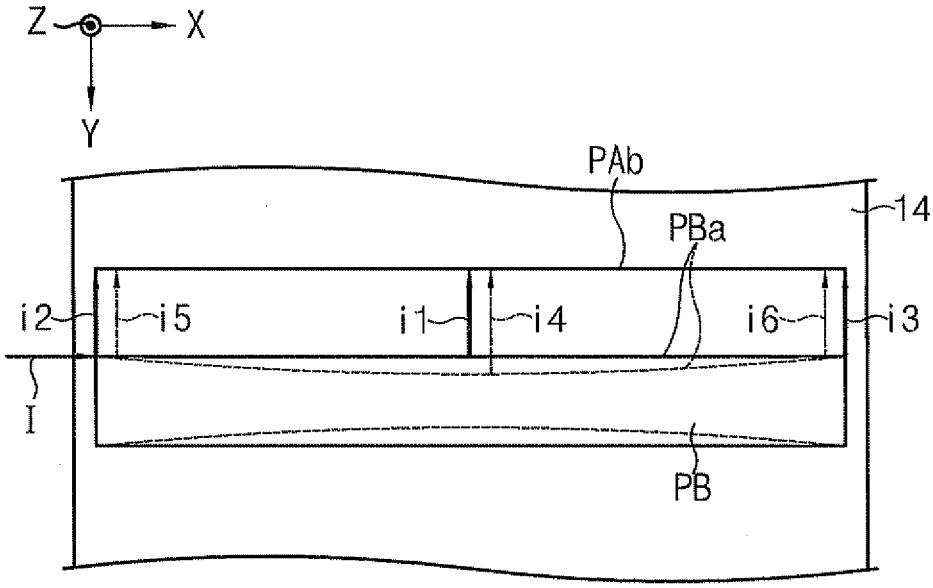
FIG. 11A is a schematic diagram illustrating a current flowing from the first contact part to the second contact part according to the first exemplary embodiment of the present invention.

As a comparative example, in a case where the shape adjusting roll 46 is not used, as denoted by broken lines in FIG. 11A, the width of the center portion of the second contact part PB in the Y direction is shorter than the width of both end portions in the Y direction. In other words, a distance between the upstream-side end portion PBa of the second contact part PB in the Y direction and the downstream-side end portion PAb of the first contact part PA at the center portion is longer than that at both end portions.

The electrical resistance of the intermediate transfer belt 14 is not zero, and thus, as the length of the path of a current (transfer current) flowing through the intermediate transfer belt 14 is increased, a current arriving at the photoreceptor 22 (see FIG. 2) decreases. Accordingly, in the comparative example, when a current I applied to the core 42A (see FIG. 3A) of the primary transfer roll 42 flows as a current i4 at the center portion of the second contact part PB and flows as currents i5 and i6 at both end portions, $i4<i5$ and $i4<i6$.

Figure 11B:
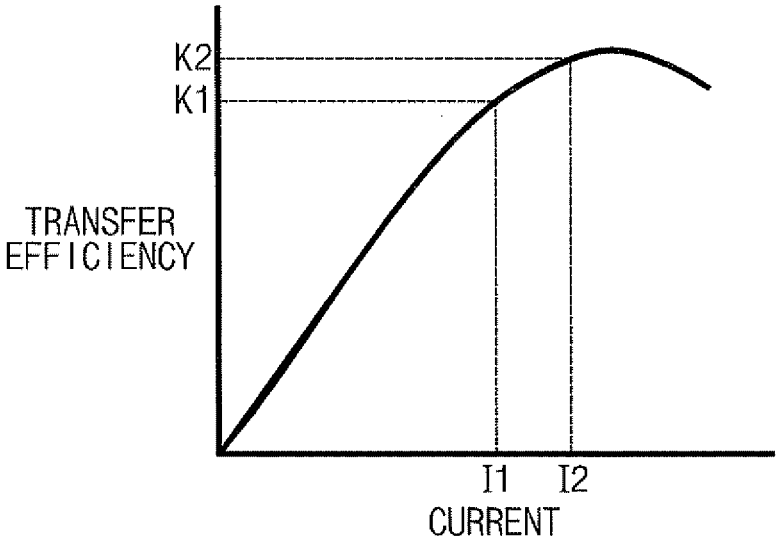
FIG. 11B is a graph illustrating a change in the transfer efficiency with respect to the current.

In FIG. 11B, as an example, the relation between the current I applied to the primary transfer roll 42 when a solid image is formed and the transfer efficiency K of toner (the ratio of the amount of toner transferred to the intermediate transfer belt 14 with respect to the amount of toner disposed on the photoreceptor 22 as 100%) is represented as a graph. In the graph illustrated in FIG. 11B, assuming that an excessive current I does not flow (a current over the apex of the graph is not applied), when the transfer efficiency at a current I1 is denoted by K1, and the transfer efficiency at a current I2 is denoted by K2, if $I1<I2$, $K1<K2$. In other words, as the current I is decreased, the transfer efficiency K decreases.

As illustrated in FIG. 11B, in the case of not a solid image but a halftone image, the current at which the transfer efficiency in the graph of the halftone image is the maximum is lower than the current at which the transfer efficiency in the graph of the solid image is the maximum. However, in FIG.

11B, the relation between the current and the transfer efficiency (the relation in the case of a solid image) that is also applicable to a halftone image is represented.

Here, as illustrated in FIG. 11A, in the comparative example, since the current i4 flowing through the center portion of the second contact part PB is lower than the currents i5 and i6 flowing through both end portions thereof, the transfer efficiency K at the center portion is lower than that at both end portions, whereby transfer unevenness (a difference between image densities) occurs.

On the other hand, according to this exemplary embodiment, as represented by rectangle-shaped solid lines in FIG. 11A, a difference between the width of the center portion of the second contact part PB in the Y direction and the width of both end portions in the Y direction is decreased. In other words, the distance between the upstream-side end portion PBa of the second contact part PB in the Y direction and the downstream-side end portion PAb of the first contact part PA is at the same level at the center portion and both end portions. Accordingly, as currents flowing from the second contact part PB to the first contact part PA, the current i1 flowing through the center portion and the currents i2 and i3 flowing through both end portions are at the same level, whereby the transfer unevenness is suppressed. In addition, by suppressing the transfer unevenness, a difference between image densities in the widthwise direction (the X direction) that occurs in accordance with the assembly state of each set decreases.

Next, results of measuring differences in the image density depending on the presence/no-presence of the shape adjusting roll 46 will be described.

In the measurement described below, as an example, the diameter of the photoreceptor 22 illustrated in FIG. 2 is set to 84 mm, the outer diameter of the primary transfer roll 42 is set to 28 mm, the outer diameter of the core 42A is set to 8 mm, and the outer diameter of the shape adjusting roll 46 is set to 10 mm. In addition, the separation distance between the first contact part PA and the center of the second contact part PB is set to 3 mm. As the primary transfer unit 40, for example, the primary transfer units 40C and 40K (see FIG. 1) corresponding to cyan (c) and black (K) are used.

In addition, three standards for the primary transfer roll 42 are used which include that there is hardly a difference (the amount of crown) between the outer diameter of a 10 mm end portion from the end-section of the urethane foam 42B in the X direction and the outer diameter of the center portion (represented as 0.00 mm), the outer diameter of the center portion is smaller than the outer diameter of the end portion by 0.05 mm (represented as −0.05 mm), and the outer diameter of the center portion is larger than the outer diameter of the end portion by 0.05 mm (represented as +0.05 mm). In addition, the contact pressure at the first contact part PA between the photoreceptor 22 and the intermediate transfer belt 14 is set to 280 gf/300 mm.

For the evaluation of the image density, a transfer current (a current applied to the primary transfer roll 42) is acquired for which each image is output without any problem by outputting test patterns including a line image, a solid image, and a halftone image in advance. Then, in the condition of the transfer current, a pattern is output (printed) in which a monochrome halftone image of 20 mm×20 mm having the input coverage (area ratio) of 30% (entirely exposure halftone image is set as 100%) is arranged on the entire A4-size face of recording paper P (see FIG. 1).

In addition, the measurement of the image density was performed by using X-Rite938 manufactured by X-Rite Inc. at a total of three positions including the position of the center portion of the recording paper P and the positions located 20 mm away from both end portions of the recording paper P. Then, an image density difference between the center portion and the right end portion and an image density difference between the center portion and the left end portion are acquired with the image density of the center portion used as a reference and are evaluated as three levels of o, Δ, and x. In the table, o indicates that there is no image density difference (|density difference Δ|≤0.01), Δ indicates that a slight image density difference is checkable (0.01<|density difference Δ|0.025), and x indicates that an image density difference is checkable (0.025<|image density Δ|). Here, the image density is a dimensionless amount.

First, results of measuring the image density for a configuration in which the shape adjusting roll 46 is not disposed as a comparative example are presented in Table 1. In the comparative example, for the primary transfer roll 42 having three kinds of the amount of crown, an image density difference is checked in one color of cyan and black.

TABLE 1

| Amount of Crown | | 0.00 mm | −0.05 mm | +0.05 mm |
|---|---|---|---|---|
| Result of Measurement of Difference in Image Density | | Difference in Image Density | Difference in Image Density | Difference in Image Density |
| Cyan | Center Right | X | X | X |
| | Center Left | X | X | X |
| Black | Center Right | X | X | Δ |
| | Center left | X | X | X |

Next, in the image forming apparatus 10 of this exemplary embodiment illustrated in FIG. 1, results of measuring the image density is represented in Table 2. The results represented in Table 2 are results after the amount of intrusion of the shape adjusting roll 46 into the primary transfer roll 42 is adjusted in advance by the pressing parts 50A and 50B (see FIG. 3A) while the image density is measured in advance. In addition, the contact position of the shape adjusting roll 46 in the primary transfer roll 42 is a position at an angle θ of 75° illustrated in FIG. 3B.

TABLE 2

| Amount of Crown | | 0.00 mm | −0.05 mm | +0.05 mm |
|---|---|---|---|---|
| Result of Measurement of Difference in Image Density | | Difference in Image Density | Difference in Image Density | Difference in Image Density |
| Cyan | Center Right | ○ | ○ | ○ |
| | Center Left | ○ | ○ | ○ |
| Black | Center Right | ○ | ○ | ○ |
| | Center left | ○ | ○ | ○ |

As illustrated in Table 2, in the image forming apparatus 10 according to this exemplary embodiment, an image having no image density difference is acquired. The reason for this is thought to be as below. As illustrated in FIGS. 2, 7B, 8B, and 9B, by pressing the shape adjusting roll 46 to the primary transfer roll 42 so as to be intruded therein, the bending due to the weight of the primary transfer roll 42 or a contact of the primary transfer roll 42 with the intermediate transfer belt 14 is corrected, and accordingly, a difference in the separation distance between the downstream end portion PAb of the first contact part PA and the upstream-side end portion PBa of the second contact part PB between the center portion (Δd1) and both end portions (Δd2 and Δd3) is decreased, and a difference between the width N1 of the center portion of the second contact part PB and the widths N2 and N3 of both end portions is decreased.

In addition, as a modified example of this exemplary embodiment, the measurement results of image densities when the contact position of the shape adjusting roll 46 with respect to the primary transfer roll 42 is at a position (see FIG. 6A) at which the angle θ is 0° are represented in Table 3.

TABLE 3

| Amount of Crown | | 0.00 mm | −0.05 mm | +0.05 mm |
|---|---|---|---|---|
| Result of Measurement of Difference in Image Density | | Difference in Image Density | Difference in Image Density | Difference in Image Density |
| Cyan | Center Right | ○ | ○ | ○ |
| | Center Left | ○ | ○ | ○ |
| Black | Center Right | ○ | ○ | ○ |
| | Center left | ○ | Δ | ○ |

As illustrated in Table 3 and FIG. 6A, it is understood that the difference between the image densities of the center portion and both end portions is decreased by only arranging the shape adjusting roll 46 right below the primary transfer roll 42.

As described above, according to the primary transfer unit 40 of this exemplary embodiment, by adjusting the shape of the primary transfer roll 42 by using the shape adjusting section 44, regarding a separation distance between the first contact part PA (or the downstream-side end portion PAb of the first contact part PA) and the upstream-side end portion PBa of the second contact part PB, the difference between the separation distance Δd1 at the center portion of the primary transfer roll 42 in the axial direction (the X direction) and the separation distances Δd2 and Δd3 at both end portions is decreased.

Accordingly, in the axial direction of the primary transfer roll 42, a difference between transfer currents flowing from the primary transfer roll 42 to the photoreceptor 22 through the intermediate transfer belt 14 is decreased. Therefore, compared to a configuration in which the primary transfer roll 42 is brought into contact with the intermediate transfer belt 14 without having bending deformation, the difference in the image densities in the center portion and both end portions in the widthwise direction (the X direction) intersecting the transporting direction of the intermediate transfer belt 14 is decreased.

In addition, in the primary transfer unit 40, the width N of the second contact part PB in the Y direction is increased, and the difference between the width N1 of the center portion and the widths N2 and N3 of both end portions in the axial direction is decreased. Accordingly, the contact pressure between the intermediate transfer belt 14 and the primary transfer roll 42 is uniform in the widthwise direction (the axial direction), whereby the bending of the intermediate transfer belt 14 is suppressed.

Furthermore, in the primary transfer unit 40, since the shape adjusting roll 46 is disposed so to be rotatable, the shape adjusting roll 46 rotates in accordance with the rotation of the primary transfer roll 42. Accordingly, compared to a case where the shape adjusting roll is fixed, the load acting on the primary transfer roll 42 at the time of rotating the primary transfer roll 42 is decreased.

In addition, in the primary transfer unit 40, since the position adjusting screw 58 is capable to directly adjust the axial distance between the shape adjusting roll 46 and the primary transfer roll 42, compared to a configuration in which the axial distance between the primary transfer roll 42 and the shape adjusting roll 46 is not adjusted, the number of components of the shape adjusting section 44 is decreased.

Furthermore, in the primary transfer unit 40, as illustrated in FIG. 3B, since the shape adjusting roll 46 is arranged on the side lower than the position (point O) of the rotation center of the primary transfer roll 42 and at a position allowing the primary transfer roll 42 to approach the photoreceptor 22 when it is pressed by the pressing parts 50A and 50B, a component force F1 in the direction opposite to the direction and the component force F2 in the Z direction act on the primary transfer roll 42. In addition, the difference between the separation distance Δd1 of the center portion and the separation distances Δd2 and Δd3 of both end portions is decreased, and the width of the second contact part PB in the Y direction increases at the center portion and both end portions in the axial direction. Accordingly, the adjustment of the position of the second contact part PB in the transporting direction of the intermediate transfer belt 14 and the adjustment of the width N of the second contact part PB are simultaneously performed.

In addition, in the primary transfer unit 40, as illustrated in FIG. 3A, since the holder 52 is included at which the pressing part 50A (50B) integrally supports the primary transfer roll 42 and the shape adjusting roll 46, even in a case where the position adjusting screw 58 is turned so as to press the shape adjusting roll 46 to the primary transfer roll 42, the installation position of the primary transfer roll 42 with respect to the intermediate transfer belt 14 is not displaced. Accordingly, compared to a configuration in which the primary transfer roll 42 and the shape adjusting roll 46 are supported in a separated manner, the misregistration of the reference position (the position at which the shape adjusting roll 46 is pressed toward the rotation center of the primary transfer roll 42) at which the intermediate transfer belt 14 and the primary transfer roll 42 are brought into contact with each other due to the positional adjustment of the shape adjusting roll 46 is suppressed.

In addition, according to the image forming apparatus 10, since the primary transfer of the toner image from the photoreceptor 22 to the intermediate transfer belt 14 is performed by each primary transfer unit 40 that includes the shape adjusting section 44, compared to a configuration in which the primary transfer roll 42 is brought into contact with the intermediate transfer belt 14 without performing bending deformation of the primary transfer roll 42 by using the shape adjusting section 44, a difference in the image density in the widthwise direction that occurs due to the attachment state of each member decreases.

Next, an example of a transfer device and an image forming apparatus according to a second exemplary embodiment of the present invention will be described. The same reference numerals as those of the first exemplary embodiment are assigned to components that are basically the same as those of the first exemplary embodiment, and the description thereof will not be presented.

Figure 12:
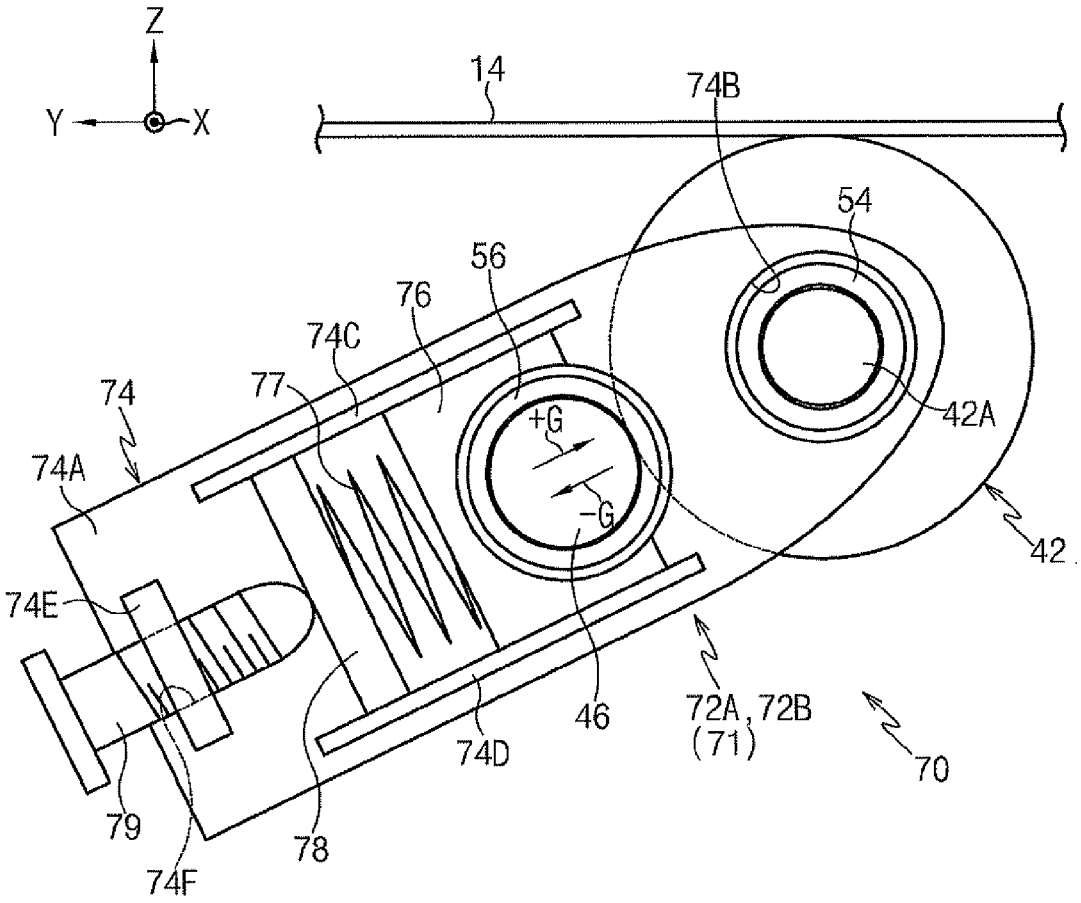
FIG. 12 is a configuration diagram of a pressing section according to a second exemplary embodiment of the present invention.

FIG. 12 illustrates a primary transfer unit 70 according to the second exemplary embodiment. The primary transfer unit 70 has a configuration that is acquired by replacing the shape adjusting section 44 with a shape adjusting section 71 as an example of a shape adjusting unit in the primary transfer unit 40 (see FIG. 3A) of the image forming apparatus 10 according to the first exemplary embodiment. In addition, the shape adjusting section 71 has a configuration that includes pressing parts 72A and 72B, which replaces the pressing parts 50A and 50B, as examples of pressing units that press a shape adjusting roll 46 to the primary transfer roll 42 and the shape adjusting roll 46. The other configurations are similar to those of the first exemplary embodiment.

The pressing part 72A is disposed at one end of the primary transfer roll 42 and the shape adjusting roll 46, and the pressing part 72B is disposed at the other end of the primary transfer roll 42 and the shape adjusting roll 46. In addition, since the members configuring the pressing part 72A and the members configuring the pressing part 72B have similar configurations, in the description below, the pressing part 72A will be described, but the description of the pressing part 72B will not be presented.

The pressing part 72A is configured to include: a holder 74 as an example of a support member that integrally supports one end of the primary transfer roll 42 and one end of the shape adjusting roll 46; a first bearing 54; a second bearing 56; a plate-shaped bearing holder 76 in which the second bearing 56 is fixed; and an urging spring 77 that urges the bearing holder 76 to the primary transfer roll 42 side; a plate member 78 to which the urging spring 77 is attached; and a pressure adjusting screw 79 that urges the plate member 78.

The holder 74 includes a holder main body 74A that is a plate member having the X direction as its thickness direction. At one end of the holder main body 74A in the longitudinal direction, a circular through hole 74B that passes through in the X direction is formed, and, in the through hole 74B, the first bearing 54 is fitted so as to be fixed. In addition, in the center portion of the holder main body 74A, plate-shaped guide rails 74C and 74D that are arranged in a direction intersecting the direction of an arrow +G and the direction of an arrow −G with a space interposed therebetween, have the direction of the arrow +G and the direction of the arrow −G as the longitudinal direction thereof, and protrude in the direction of an arrow X are integrally formed. Furthermore, at the other end of the holder main body 74A, a plate-shaped support part 74E protruding in the direction of the arrow X is integrally formed.

The guide rails 74C and 74D are arranged to be parallel to each other, and, on the inner side of the guide rails 74C and 74D, the bearing holder 76 and the plate member 78 are fitted so as to be slidable in the direction of the arrow +G or the direction of the arrow −G. In addition, one end of the urging spring 77 is fixed to the bearing holder 76, and the other end thereof is fixed to the plate member 78.

In addition, in the support part 74E, a screw hole 74F passing through the direction of the arrow +G is formed, and, in the screw hole 74F, the pressure adjusting screw 79 is screwed. Furthermore, the lead edge of the pressure adjusting screw 79 is brought into contact with the other face (the lower side in the figure) of the plate member 78.

Next, the operation of the second exemplary embodiment will be described.

As illustrated in FIG. 12, when the pressure adjusting screw 79 is turned in the direction of the arrow +G, the plate member 78 is slid along the guide rails 74C and 74D in the direction of the arrow +G. Then, depending on the elastic force of the urging spring 77 that is compressed in accordance with the movement of the plate member 78, the bearing holder 76 is slid in the direction of the arrow +G, and the shape adjusting roll 46 is pressed to the outer circumferential face of the primary transfer roll 42.

On the other hand, when the pressure adjusting screw 79 is turned in a retreating direction toward the direction of the arrow −G, the plate member 78 is slid along the guide rails 74C and 74D in the direction of the arrow −G depending on the weight thereof and the elastic force of the urging spring 77. Then, depending on the elastic force of the urging spring 77 that has been stretched in accordance with the movement of the plate member 78, the bearing holder 76 is slid in the direction of the arrow −G, and the shape adjusting roll 46 retreats from the outer circumferential face of the primary transfer roll 42.

As above, the primary transfer unit 70 is capable to adjust the pressure by bringing the pressure adjusting screw 79 into contact with the primary transfer roll 42 and the shape adjusting roll 46. Accordingly, even in a case where the primary transfer roll 42 or the shape adjusting roll 46 is eccentric, the shape adjusting roll 46 is brought into contact with the primary transfer roll 42 in accordance with the elastic force of the urging spring 77.

In addition, according to the primary transfer unit 70, by adjusting the shape of the primary transfer roll 42 by using the shape adjusting section 71, as illustrated in FIG. 7B, regarding a separation distance between the first contact part PA (or the downstream-side end portion PAb of the first contact part PA) and the upstream-side end portion PBa of the second contact part PB, the difference between the separation distance Δd1 at the center portion of the primary transfer roll 42 in the axial direction (the X direction) and the separation distances Δd2 and Δd3 at both end portions is decreased.

Accordingly, in the axial direction of the primary transfer roll 42, a difference between transfer currents flowing from the primary transfer roll 42 and the photoreceptor 22 through the intermediate transfer belt 14 is decreased. Therefore, compared to a configuration in which the primary transfer roll 42 is brought into contact with the intermediate transfer belt 14 without having bending deformation, the difference in the image densities in the center portion and both end portions in the widthwise direction (the X direction) intersecting the transporting direction of the intermediate transfer belt 14 is decreased.

In addition, in the primary transfer unit 70, as illustrated in FIG. 7B, the width N (N1, N2, and N3) of the second contact part PB in the Y direction is increased, and the difference between the width N1 of the center portion and the widths N2 and N3 of both end portions in the axial direction is decreased. Accordingly, the contact pressure between the intermediate transfer belt 14 and the primary transfer roll 42 is uniform in the widthwise direction (the axial direction), whereby the bending of the intermediate transfer belt 14 is suppressed.

In addition, according to the image forming apparatus 10, since the primary transfer of the toner image from the photoreceptor 22 to the intermediate transfer belt 14 is performed by each primary transfer unit 70 that includes the shape adjusting section 71, compared to a configuration in which the primary transfer roll 42 is brought into contact with the intermediate transfer belt 14 without performing bending deformation of the primary transfer roll 42 by using the shape adjusting section 71, a difference in the image density in the widthwise direction that occurs due to the attachment state of each member decreases.

Figure 13:
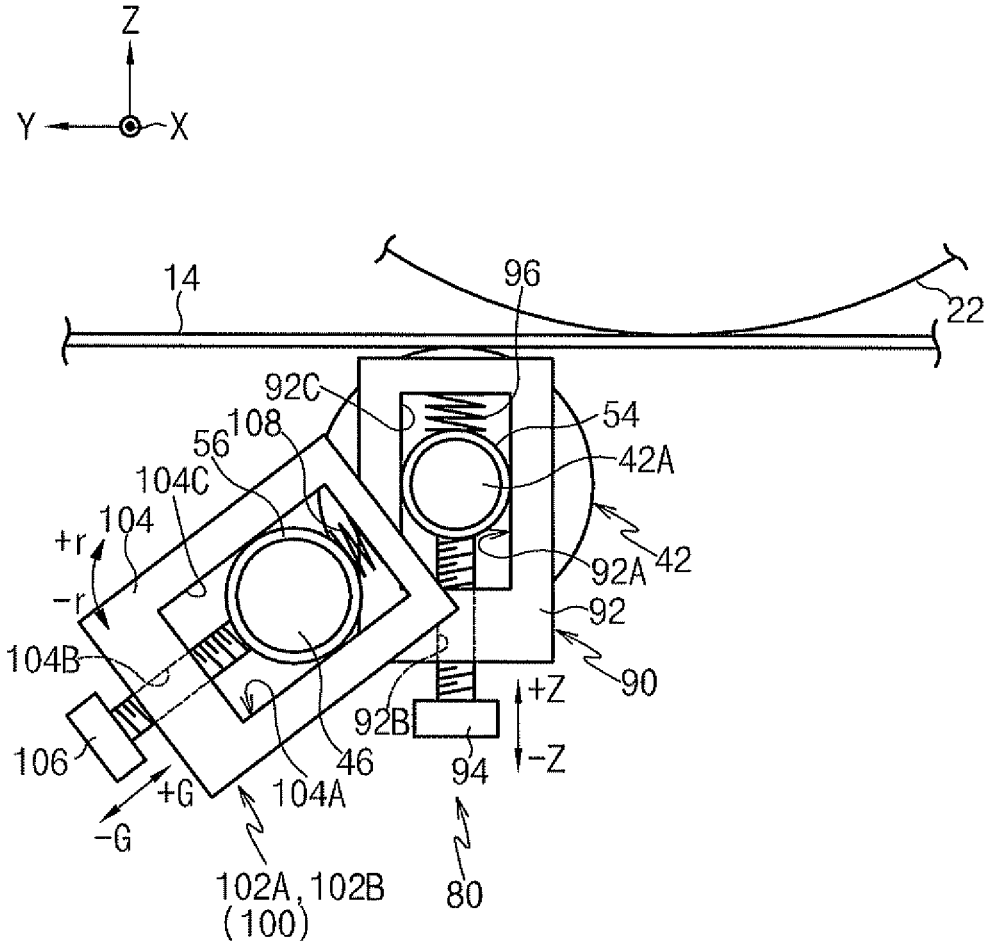
FIG. 13 is a configuration diagram of a pressing section according to a modified example of the first and second exemplary embodiments of the present invention.

Here, FIG. 13 illustrates a primary transfer unit 80 as a modified example of the primary transfer unit 40 (see FIG. 2) according to the first exemplary embodiment and the primary transfer unit 70 (see FIG. 12) according to the second exemplary embodiment.

The primary transfer unit 80 has a configuration in which a sliding section 90 that slides the primary transfer roll 42 in the +Z direction or the −Z direction and a shape adjusting section 100 as examples of the shape adjusting unit are disposed. The shape adjusting section 100 has a configuration including pressing parts 102A and 102B as an example of pressing units that press the shape adjusting roll 46 to the primary transfer roll 42 and a shape adjusting roll 46. The other configurations are similar to those of the first exemplary embodiment.

The sliding section 90 includes a holder 92 that is fixed inside the enclosure housing 12 (see FIG. 1) of the image forming apparatus 10 by using a bracket (not illustrated in the figure). The holder 92 is a plate member having the X direction as its thickness direction, and, in the center portion of the holder 92, a rectangle-shaped opening portion 92A that passes through in the X direction is formed. In addition, in the holder 92, a screw hole 92B is formed which passes through from the other end side in the longitudinal direction of the holder 92 toward the inside of the opening portion 92A.

In the opening portion 92A, the outer circumferential face of the first bearing 54 is brought into contact with one set of the inner walls 92C corresponding to the longer sides of the rectangle. In addition, on the front side and the rear side of the inner wall 92C in the X direction, a plate shaped stopper member (not illustrated in the figure) is disposed by bypassing the core 42A, whereby the first bearing 54 is prevented from being disengaged from the opening portion 92A.

In addition, in the screw hole 92B of the holder 92, a position adjusting screw 94 is screwed. The lead edge portion of the position adjusting screw 94 is brought into contact with the outer circumferential face of the first bearing 54. Furthermore, inside the opening portion 92A, an urging spring 96 having one end attached to the inner wall (reference numeral is not illustrated) of the opening portion 92A and the other end urging the first bearing 54 in the direction of the arrow −Z is disposed.

Accordingly, when the position adjusting screw 94 is turned in an advancing direction, the first bearing 54 is slid along the inner wall 92C of the opening portion 92A in the direction (a direction in which the primary transfer roll 42 approaches the intermediate transfer belt 14) of the arrow +Z. On the other hand, when the position adjusting screw 94 is turned in a retreating direction, the first bearing 54 is slid along the inner wall 92C in the direction (a direction in which the primary transfer roll 42 is separated away from the intermediate transfer belt 14) of the arrow −Z.

The pressing parts 102A and 102B include a holder 104 that is supported so as to be rotatable in the direction of an arrow +r or the direction of an arrow −r within the Y-Z plane by using a bracket (not illustrated in the figure) inside the enclosure housing 12 (see FIG. 1) of the image forming apparatus 10. The holder 104 is a plate member having the X direction as its thickness direction, and, in the center portion of the holder 104, a rectangle-shaped opening portion 104A that passes through in the X direction is formed. In addition, in the holder 104, a screw hole 104B is formed which passes through from the other end side in the longitudinal direction of the holder 104 toward the inside of the opening portion 104A.

In the opening portion 104A, the outer circumferential face of the second bearing 56 is brought into contact with one set of the inner walls 104C corresponding to the longer sides of the rectangle. In addition, on the front side and the rear side of the inner wall 104C in the X direction, a plate-shaped stopper member (not illustrated in the figure) is disposed by bypassing the shape adjusting roll 46, whereby the second bearing 56 is prevented from being disengaged from the opening portion 104A.

In addition, in the screw hole 104B of the holder 104, the position adjusting screw 106 is screwed, and the lead edge portion of the position adjusting screw 106 is brought into contact with the outer circumferential face of the second bearing 56. Furthermore, inside the opening portion 104A, an urging spring 108 having one end attached to the inner wall (reference numeral is not illustrated) of the opening portion 104A and the other end urging the second bearing 56 in the direction of the arrow −G is disposed.

Accordingly, when the position adjusting screw 106 is turned in an advancing direction, the second bearing 56 is slid along the inner wall 104C of the opening portion 104A in the direction (a direction in which the shape adjusting roll 46 approaches the primary transfer roll 42) of the arrow +G. On the other hand, when the position adjusting screw 106 is turned in a retreating direction, the second bearing 56 is slid along the inner wall 104C in the direction (a direction in which the shape adjusting roll 46 is separated away from the primary transfer roll 42) of the arrow −G.

Here, for example, when the position of the primary transfer roll 42 is moved in the direction of the arrow +Z by turning the position adjusting screw 94, the rotation center of the primary transfer roll 42 is not located on the axis of rotation (not illustrated in the figure) of the position adjusting screw 106. Accordingly, after the holder 104 is moved in the direction of the arrow −r so as to locate the rotation center of the primary transfer roll 42 on the axis (not illustrated) of rotation of the position adjusting screw 106, the position adjusting screw 106 is turned. Therefore, even in a case where the position of the primary transfer roll 42 in the direction of the arrow Z changes, the shape adjusting roll 46 is pressed toward the rotation center of the primary transfer roll 42.

As illustrated in Table 4, it may be understood that the difference in the image densities of the center portion and both end portions is decreased even in a case where the primary transfer roll 42 and the shape adjusting roll 46 are configured to be independently supported by different holders 92 and 104.

TABLE 4

| Amount of Crown | | 0.00 mm | −0.05 mm | +0.05 mm |
|---|---|---|---|---|
| Result of Measurement of Difference in Image Density | | Difference in Image Density | Difference in Image Density | Difference in Image Density |
| Cyan | Center Right | ○ | Δ | ○ |
| | Center Left | ○ | Δ | ○ |
| Black | Center Right | ○ | Δ | ○ |
| | Center left | Δ | Δ | ○ |

Next, an example of a transfer device and an image forming apparatus according to a third exemplary embodiment of the present invention will be described. The same reference numerals as those of the first and second exemplary embodiments are assigned to components that are basically the same as those of the first and second exemplary embodiments, and the description thereof will not be presented.

Figure 14:
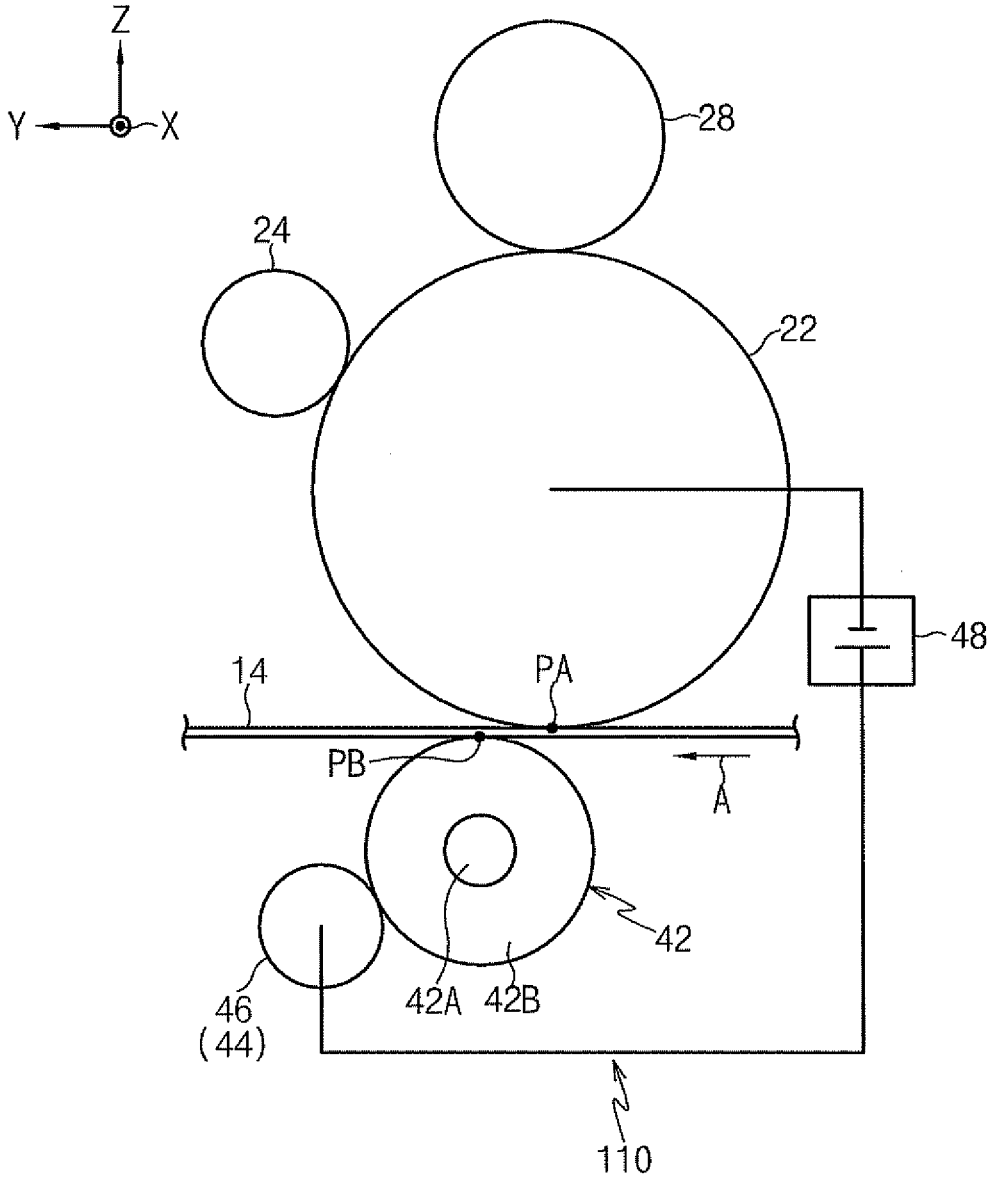
FIG. 14 is a configuration diagram of an image forming section and a primary transfer unit according to a third exemplary embodiment of the present invention.

FIG. 14 illustrates a primary transfer unit 110 according to the third exemplary embodiment. The primary transfer unit 110 has a configuration that is acquired by changing the connection destination of the voltage applying section 48 that is located on a side opposite to the photoreceptor 22 side from the core 42A of the primary transfer roll 42 to the shape adjusting roll 46 in the primary transfer unit 40 (see FIG. 3A)

according to the first exemplary embodiment. In addition, the primary transfer roll 42 is in a floating state. The other configurations are similar to those of the first exemplary embodiment.

The electrical resistance of the shape adjusting roll 46 is lower than that of the primary transfer roll 42. In addition, a voltage used for generating an electric potential difference between the photoreceptor 22 and the primary transfer roll 42 is applied to the shape adjusting roll 46 by the voltage applying section 48.

Next, the operation of the third exemplary embodiment will be described.

By using the shape adjusting section 44, as described above, in the axial direction of the primary transfer roll 42, a difference between transfer currents flowing from the primary transfer roll 42 to the photoreceptor 22 through the intermediate transfer belt 14 is decreased. Therefore, compared to a configuration in which the primary transfer roll 42 is brought into contact with the intermediate transfer belt 14 without having bending deformation, the difference between the image densities of the center portion and both end portions in the widthwise direction (the X direction) intersecting the transporting direction of the intermediate transfer belt 14 is decreased.

In addition, according to the image forming apparatus 10, since the primary transfer of the toner image from the photoreceptor 22 to the intermediate transfer belt 14 is performed by each primary transfer unit 110 that includes the shape adjusting section 44, compared to a configuration in which the primary transfer roll 42 is brought into contact with the intermediate transfer belt 14 without having bending deformation, a difference in the image density in the widthwise direction that occurs due to the attachment state of each member decreases.

Figure 15A:
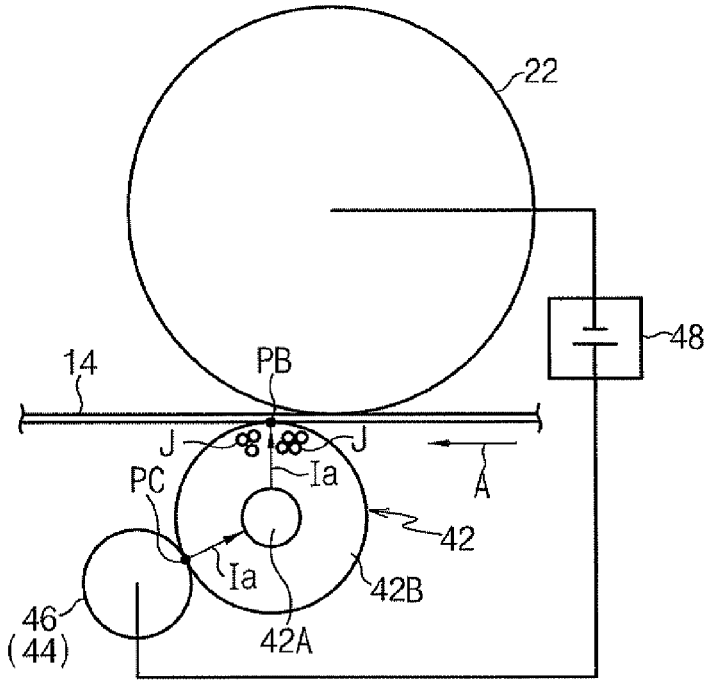
FIGS. 15A and 15B are schematic diagrams illustrating a state in which a transfer current flows when primary transfer is performed by applying a voltage to the shape adjusting roll according to the third exemplary embodiment of the present invention.

As illustrated in FIG. 15A, in the primary transfer unit 110, when a voltage is applied to the shape adjusting roll 46 by the voltage applying section 48 in a state in which the shape adjusting roll 46 is brought into contact with the primary transfer roll 42, near a contact part PC between the shape adjusting roll 46 and the primary transfer roll 42, a current Ia flows in a direction from the surface (the outer circumferential face) of the primary transfer roll 42 toward the core 42A. In addition, near the second contact part PB, a current Ia flows from the core 42A to the surface of the primary transfer roll 42. At this time, apart of ions J (small circles illustrated in the figure) of the ion conducting agent is eccentrically located (polarized) on the outer circumferential side (the second contact portion PB side).

Figure 15B:
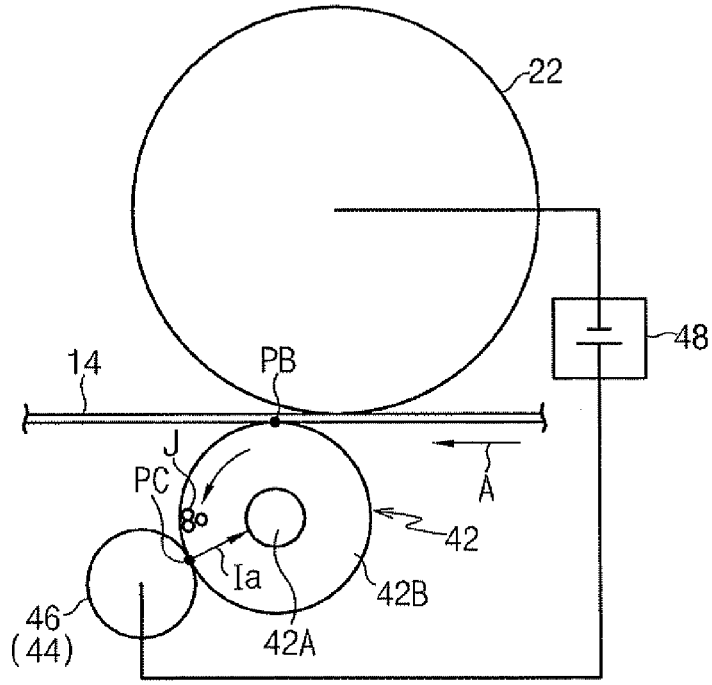

Subsequently, as illustrated in FIG. 15B, when the primary transfer roll 42 rotates, a portion at which the ions J are eccentrically located inside the primary transfer roll 42 moves to the contact part PC between the shape adjusting roll 46 and the primary transfer roll 42. Then, the ions J move again toward the core 42A. As above, the direction of the electric filed is reversed every time the primary transfer roll 42 rotates, and the operation of alternately applying a positive voltage and a negative voltage may be thought to be acquired, whereby the polarization of the primary transfer roll 42 is thought to be suppressed. In addition, since the polarization of the primary transfer roll 42 is suppressed, the increase in the electrical resistance of the primary transfer roll 42 is suppressed.

Next, the results of measuring the image densities in the image forming apparatus 10 according to the third exemplary embodiment are illustrated in Table 5. The results of Table 5 are results after the amount of intrusion of the shape adjusting roll 46 into the primary transfer roll 42 is adjusted in advance by the pressing parts 50A and 50B (see FIG. 3A) when the image density is measured. In addition, the contact position of the shape adjusting roll 46 with respect to the primary transfer roll 42 is the position at which the angle θ illustrated in FIG. 3B is 75°.

TABLE 5

| Amount of Crown | | 0.00 mm | −0.05 mm | +0.05 mm |
|---|---|---|---|---|
| Result of Measurement of Difference in Image Density | | Difference in Image Density | Difference in Image Density | Difference in Image Density |
| Cyan | Center Right | ○ | ○ | ○ |
| | Center Left | ○ | ○ | ○ |
| Black | Center Right | ○ | ○ | ○ |
| | Center left | ○ | ○ | ○ |

As illustrated in Table 5, also in the image forming apparatus 10 according to the third exemplary embodiment, an image having no image density difference may be acquired.

The present invention is not limited to the above-described exemplary embodiments.

The primary transfer roll 42 may be disposed on the upstream side of the first contact part PA in the transporting direction of the intermediate transfer belt 14. In such a case, since the second contact part is located on the upstream side, inter-axis distances Δd1, Δd2, and Δd3 are defined between the downstream-side end portion PBb (not illustrated in the figure) of the second contact part and the upstream-side end portion PAa (not illustrated in the figure) of the first contact part, but it is apparent to those skilled in the art that the present invention may be applied to the case similar to a case where the primary transfer roll 42 is located on the downstream side. In addition, in a configuration in which the backup roll 38 and the secondary transfer roll 41 are arranged so as to be deviated from the transporting direction of the intermediate transfer belt 14, the shape adjusting section 44, 71, or 100 may be used as the secondary transfer roll 41. In such a case, the intermediate transfer belt 14 is an example of an image supporting member, and the recording paper P is an example of a transfer member. In addition, the shape adjusting section 44, 71, or 100 may be used as the backup roll 38.

In the image forming apparatus 10 according to the third exemplary embodiment, instead of the shape adjusting section 44, the shape adjusting section 71 may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

a first image holding body having a developer image formed thereon;

a second image holding body that contacts with the first image holding body in a first contact area located on a first face of the second image holding body;

a transfer member that contacts with the second image holding body in a second contact area located on a second face of the second image holding body, the first image holding body transferring the developer image to the second image holding body, the second contact area being on an opposed side of the second image holding body from the first contact area:

the second contact area being located at a different position in a longitudinal direction of the second image holding body than the first contact area, the transfer member having a conductive surface layer that is rotatable around a first rotation axis, the conductive surface layer adapted to be elastically transformed, and the transfer member applying a voltage to transfer the developer image from the first image holding body to the second image holding body;

an adjustment unit that adjusts the transfer member to reduce, along a direction of the first rotation axis, differences of a distance between the first contact area and the second contact area.

2. The transfer device according to claim 1, wherein the adjustment unit comprises:

a shape adjusting member that contacts with the conductive surface layer along a direction of the first rotation axis: and a pressing unit that presses the shape adjusting member toward the conductive surface layer, wherein the degree of pressing applied by the pressing unit is respectively adjustable at different positions in the direction of the first rotation axis.

3. The transfer device according to claim 2, wherein the shape adjusting member is rotatable around a second rotation axis that is approximately parallel to the first rotation axis, and wherein the adjustment unit adjusts distances from at least two positions to the first rotation axis in the direction along the second rotation axis.

4. The transfer device according to claim 2, wherein the shape adjusting member is rotatable around a second rotation axis that is approximately parallel to the first rotation axis, and wherein the adjustment unit adjusts pressures applied from at least two positions to the conductive surface layer in the direction along the second rotation axis.

5. The transfer device according to claim 1, wherein the transformation member and the adjustment unit are respectively arranged so as to be able to transform and adjust a shape of a first end portion of the second contact area that is located on a side facing the first contact area, the transformation of the shape of the first end portion being caused by the elastic transformation of the transfer member.

6. The transfer device according to claim 5, wherein the transformation member and the adjustment unit are respectively arranged so as to be able to transform and adjust the shape of the first end portion such that a gap between the first end portion and a second end portion of the first contact area that is located on a side facing the second contact area is adjustable at least two positions in the direction along the rotation axis.

7. The transfer device according to claim 2, wherein the shape adjusting member is rotatable around a second rotation axis that is approximately parallel to the first rotation axis, and the second rotation axis is located at a position farther than the first rotation axis from the transfer member.

8. The transfer device according to claim 1, further comprising:

a support member that supports the transfer member and the shape adjusting member.

9. The transfer device according to claim 1, wherein the electrical resistance of the adjustment unit is lower than the electrical resistance of the conductive surface layer of the transfer member, and wherein the transfer device further comprises a voltage applying unit that is electrically connected to the adjustment unit and supplies a transfer voltage to the transfer member.

10. An image forming apparatus comprising:

a first image holding body having a developer image formed thereon;

a developer image forming unit that forms a developer image on a surface of the first image holding body;

a second image holding body that is transported from an upstream side toward a downstream side and contacts with the first image holding body in a first contact area located on a first face of the second image holding body; and a transfer member that is used for transferring the developer image formed on the surface of the first image holding body to the second image holding body, and contacts with the second image holding body in a second contact area located on a second face of the second image holding body, the second contact area being on an opposed side of the second image holding body from the first contact area, the second contact area being located at a different position in a longitudinal direction of the second image holding body than the first contact area, the transfer member having:

a conductive surface layer that is rotatable around a first rotation axis, the conductive surface layer adapted to be elastically transformed, and an adjustment unit that adjusts the transfer member to reduce, along a direction of the first rotation axis, differences of a distance between the first contact area and the second contact area.

11. The image forming apparatus according to claim 10, wherein adjusting member comprises:

a shape adjusting member that contacts with the conductive surface layer along a direction of the first rotation axis, and a pressing unit that presses the shape adjusting member toward the conductive surface layer, wherein the degree of pressing applied by the pressing unit is respectively adjustable at different positions in the direction of the first rotation axis.

12. The image forming apparatus according to claim 11, wherein the shape adjusting member is rotatable around a second rotation axis that is approximately parallel to the first rotation axis, and the adjustment unit adjusts distances from at least two positions to the first rotation axis in the direction along the second rotation axis.

13. The image forming apparatus according to claim 11, wherein, the shape adjusting member is rotatable around a second rotation axis that is approximately parallel to the first rotation axis, and the adjustment unit adjusts pressures applied from at least two positions to the conductive surface layer in the direction along the second rotation axis.

14. The image forming apparatus according to claim 11, wherein, the shape adjusting member is rotatable around a second rotation axis that is approximately parallel to the first rotation axis, and the second rotation axis is located at a position farther than the first rotation axis from the transfer member.

15. The image forming apparatus according to claim 10, wherein the transfer device further comprises:

a support member that supports the transfer member and the shape adjusting member.

16. The image forming apparatus according to claim 10, wherein the electrical resistance of the adjustment member is lower than the electrical resistance of the conductive surface layer of the transfer member, and wherein the transfer device further comprises:

a voltage applying unit that is electrically connected to the adjustment member and supplies a transfer voltage to the transfer member.

* * * * *